US005621425A

United States Patent [19]

Hoshino et al.

[11] Patent Number: 5,621,425

[45] Date of Patent: Apr. 15, 1997

[54] LIQUID CRYSTAL DISPLAY DEVICE

[75] Inventors: Masafumi Hoshino; Shigeru Senbonmatsu; Hirotomo Oniwa; Shuhei Yamamoto, all of Tokyo, Japan

[73] Assignee: Seiko Instruments Inc., Japan

[21] Appl. No.: 172,633

[22] Filed: Dec. 21, 1993

[30] Foreign Application Priority Data

| | | | |
|---|---|---|---|
| Dec. 24, 1992 | [JP] | Japan | 4-344246 |
| Mar. 23, 1993 | [JP] | Japan | 5-064425 |
| Mar. 24, 1993 | [JP] | Japan | 5-065760 |
| Mar. 24, 1993 | [JP] | Japan | 5-065761 |
| Jun. 28, 1993 | [JP] | Japan | 5-157449 |
| Jun. 28, 1993 | [JP] | Japan | 5-157450 |
| Jun. 28, 1993 | [JP] | Japan | 5-157451 |

[51] Int. Cl.[6] ..... G09G 3/36

[52] U.S. Cl. ..... 345/94; 345/100

[58] Field of Search ..... 345/87, 88, 89, 345/94, 95, 96, 97, 98, 99, 100, 103; 359/54, 55; 382/41, 43, 281, 276

[56] References Cited

U.S. PATENT DOCUMENTS 4,602,292 7/1986 Togashi et al. ..... 345/103

FOREIGN PATENT DOCUMENTS 0507061 10/1992 European Pat. Off. ..... 345/98

OTHER PUBLICATIONS

Scheffer et al., "Active Addressing Method for High–Contrast Video Rate STN Display", SID 92, Digest, pp. 228–231.

Nehring et al., "Ultimate Limits for Matrix Addressing of RMS–Responding Liquid–Crystal Displays", 1979 IEEE vol. ED–26, No. 5 pp. 795–802.

Ruckmoncathan, "A Generalized Addressing Technique For RMS–Responding Matrix–LCDS", 1988 International Display Research Conference, pp. 80–85.

*Primary Examiner*—Richard Hjerpe
*Assistant Examiner*—Xiao M. Wu
*Attorney, Agent, or Firm*—Adams & Wilks

[57] ABSTRACT

The liquid crystal display device is comprised of a matrix panel 1, a common driver 2 and a segment driver 3. A liquid crystal layer is interposed between rows of the scanning electrodes 4 and columns of signal electrodes 5. A frame memory 6 stores an inputted dot data each frame. An orthonormal signal generator 7 generates a set of orthonormal signals to sequentially feed the same in a desired combination pattern to the common driver 2 to concurrently drive a multiple of the scanning electrodes 4 to effect group sequential scanning according to the combination pattern. A dot product computation unit 8 executes dot product computation between a set of the dot data and the set of the orthonormal signals, the result of which is fed to the segment driver 3 to drive the columns of the signal electrodes 5. The group sequential scanning is repeated several times within one cycle to display a picture. The orthonormal signals are horizontally or vertically shifted to improve the quality of the displayed picture. Further, the multiple concurrent line number is optimized to balance the withstand voltage between the common driver 2 and the segment driver 3. Moreover, in the gray shading display by pulse-height modulation, a voltage pulse assigned to a virtual line of the scanning electrode is spread out to improve the gray shaded quality of the displayed picture.

8 Claims, 28 Drawing Sheets

LIQUID CRYSTAL DISPLAY DEVICE

BACKGROUND OF THE INVENTION

The present invention relates to a liquid crystal display device. More specifically, the present invention relates to a driving method of a plain matrix panel using an SIN liquid crystal or the like. More specifically, the present invention relates to a driving method suitable for multiple line selection addressing.

The liquid crystal display device features compact size, light weight, flat shape and low power consumption, which are advantageous as compared to other types of display devices. Therefore, recently intensive work has been conducted for commercialization of the liquid crystal display device. The liquid crystal display device is generally classified an active matrix type and a plain or passive matrix type. The former type is constructed such that either a three-terminal element such as a thin film transistor or a two-terminal element such as an MIM diode is connected to each pixel to drive a liquid crystal. High contrast can be obtained compared to a static drive even through a number of multiplexing pixels increases. However, since the thin film semiconductor element is formed individually for each pixel, the construction is complicated to thereby raise production cost as the display size is expanded. On the other hand, the latter type is constructed such that rows of scanning electrodes and columns of signal electrodes sandwich therebetween a TN liquid crystal or an STN liquid crystal. Such a construction advantageously reduces a production cost. However, this type is driven in time-sharing manner according to a voltage averaging method, hence there is a drawback in that an effective voltage difference between ON and OFF states decreases as the multiplexing number is increased, thereby lowering the image contrast.

As the background, brief description is given to the voltage averaging method which is conventionally adopted for driving the plain matrix type liquid crystal display device. In this method, the respective scanning electrodes are sequentially selected one by one, while all of the signal electrodes are applied with data signals representative of the ON/OFF states of the pixels in synchronization with each selecting timing. Consequently, each pixel receives a high voltage of one time slot (1/N of a frame time interval) within one frame period during which N of the scanning electrodes are selected, while the same pixel receives a constant bias voltage in the remaining time interval ((N−1)/N of the frame time interval). In case that the liquid crystal material has a slow response, there can be obtained a brightness corresponding to an effective voltage of the applied waveform during one frame period. However, if a frame frequency is lowered as the multiplexing number increases, a difference between the one frame period time and a liquid crystal response time is reduced so that the liquid crystal responds to each applied pulse to thereby cause a brightness flicker called "frame response" which degrades the image contrast. FIG. 15 is a graph showing the frame response. A transmittance of the liquid crystal rises when a scanning electrode is selected, and then the transmittance gradually falls in a nonselecting period.

In order to eliminate the frame response using the voltage averaging method, two different countermeasures have been proposed, one of which is the "high frequency drive method" for reducing a width of a high voltage pulse, and the other of which is the "optimization of bias level" method for reducing a potential difference between the high voltage pulse and the bias voltage. FIG. 16 is a graph showing a transmittance variation in the high frequency drive. As compared to the FIG. 15 graph, the frame frequency is boosted as the pulse width is reduced. The high voltage pulse is applied at a selection timing by a shortened period, hence a next high voltage pulse is fed before the transmittance falls to a minimum level to thereby raise the overall transmittance. However, this high frequency drive has a drawback in that distortion of the applied waveform may seriously hinder uniformity of the displayed picture.

In turn, FIG. 17 is a graph showing a transmittance variation in case that the bias level is optimized. The bias voltage level is raised in the nonselection period so as to reduce an effective voltage difference between the selection and nonselection periods. As compared to the FIG. 15 graph, the fall of the transmittance is saved in the nonselection period. However, this bias level optimization method suffers from a drawback in that a voltage ratio of ON and OFF states decreases to degrade the display contrast.

With regard to the various drawbacks of the voltage averaging method, a consistent solution has been proposed "Multiple Line Selection", which was reported, for example, in SID '92 DIGEST pp232–235, 1992, by Optorex. Further, a similar method the "Active Addressing Method" was disclosed in SID '92 DIGEST pp228–231, 1992, by In Focus Systems, Inc. These multiple line selection methods are based on the principle of the high frequency drive; however, a multiple of lines are concurrently selected in contrast to the conventional single line selection to equivalently achieve the same effect as the high frequency drive. As opposed to the single line selection, the multiple line selection requires a specific technique for realizing a free display. Namely, an original picture signal is arithmetically processed to drive the signal electrodes. A basic computation scheme was proposed by T. N. Ruckmongathan in 1988 (1988 IDRC, pp80–85, 1988).

Further, In Focus Systems Inc. proposed "Pulse-Height Modulation (PHM) Gray Shading Methods for Passive Matrix" in JAPAN DISPLAY 1992-69, which can be combined with the multiple line selection method. In this pulse-height modulation gray shading method, a virtual scanning line is provided in addition to a plurality of actual scanning lines. A virtual picture data set is assigned to pixels on the virtual scanning line. This virtual data is computed based on picture data (dot data) which is assigned to actual pixels. On the other hand, a signal waveform applied to each signal line is obtained by arithmetically processing those of the actual and virtual picture data according to the aforementioned multiple line selection method. By providing the virtual line in such a manner, each pixel can receive a correct effective voltage according to the given picture data. Stated otherwise, the virtual line is provided for adjustment in order to correctly apply an effective voltage to the pixels according to the given picture data.

SUMMARY OF THE INVENTION

A practical and efficient circuit architecture is required to apply the multiple line selection method to the driving of the plain matrix type liquid crystal display device. Therefore, a first object of the present invention is to provide a drive circuit structure suitable for the multiple line selection method.

In the multiple line selection method, a pair comprising a common driver and segment driver are utilized to drive a and matrix panel comprised of multiple rows of scanning electrodes, multiple columns of signal electrodes, and a liquid crystal layer interposed therebetween. In this construction, a set of orthonormal signals is sequentially fed to the common driver such that the scanning electrodes are selectively driven in group sequential manner in which a group of a given number of lines are concurrently selected, while the segment driver receives a dot product signal which is obtained by dot product computation of a set of dot data and a set of orthonormal signals so as to drive the signal electrodes in synchronization with the group sequential scanning. The common driver applies to the scanning electrodes row scan signals in the form of a set of the orthonormal waveforms having given voltage levels. The segment driver receives the dot product signals having variable voltage levels according to the dot data representative of a picture pattern, and feeds the dot product signals to the signal electrodes as column data signals. In such a case, it is required to balance a withstand voltage between the common and segment drivers in view of promoting a simplification of hardware construction and a common usage of driver IC components. Thus, a second object of the invention is to achieve the withstand voltage balance therebetween.

In the multiple selection method, the orthonormal signals applied to the scanning electrodes may have various waveforms; however, in any waveform, all the concurrently selected lines momentarily receive a voltage pulse of the same polarity once every half cycle. On the other hand, the respective signal electrodes are applied with the data signals obtained by the dot product computation of the dot data set and the orthonormal signal set. Accordingly, as long as the dot data represents a random picture patterns, the bias voltage is randomly distributed throughout the nonselection period during each half cycle. However, in case that the picture pattern is turned to either of a total white state or a total black state, the bias voltage of the nonselection period is intensively applied at a time slot when all the selected lines receive a voltage pulse of the same polarity. For this, optical response is fluctuated to cause contrast variation dependently on the picture pattern. Thus, a third object of the invention is to eliminate the optical response fluctuation dependent on the picture pattern.

In the multiple line selecting method, respective ones of the concurrently selected scanning electrode lines must receive different signal waveforms such as the aforementioned orthonormal signals. Accordingly, as the number of the concurrently selected lines is increased, a frequency difference is expanded between one waveform applied to the first line and another waveform applied to the last line concurrently selected with the first line. On the other hand, the column data signals applied to the signal electrodes are computed in terms of the dot product of the matrix dot data and the row orthonormal signals, so that an actual bias voltage across the liquid crystal pixel is a composite of the row orthonormal signal and the column data signal. In case that a number n of the concurrently selected lines is smaller than a root square value of the total line number N, the voltage level of the scanning electrode is made higher than that of the signal electrode so that the waveform of the orthonormal signal significantly attributes to a frequency of the composite signal. On the other hand, in case that the concurrently selected line number n is greater than a root square value of the total line number N, the voltage level of the signal line becomes higher dependently on the picture pattern than that of the scanning electrode, hence the waveform of the column data signal significantly attributes to the frequency of the composite signal. Generally, a transmittance of the liquid crystal varies due to a frequency characteristic of the liquid crystal. As recognized by the above discussion, in case that the concurrently selected line number is considerably smaller than the total line number N, the transmittance difference occurs between the first and last lines of the concurrently selected scanning electrodes, thereby generating a horizontal stripe shade at a pitch of the concurrently selected lines. Thus, a fourth object of the invention is to suppress a stripe disturbance shade due to the frequency-dependence of the liquid crystal.

In case that the gray shading is effected by the pulse-height modulation in the multiple line selection method, the virtual dot data assigned to the virtual line is computed based on the actual matrix dot data. Each actual dot data may take a continuous value in the range of "−1" to "+1" in the gray shading display. In the pulse-height modulation, the value of the virtual dot data has a maximum value proportional to a root value of the total line number N when each matrix dot data has the value "0". Therefore, as the total line number N increases, the value of the virtual dot data rises. For this, when the picture pattern is held totally in a just intermediate gray state between the complete black and white states, a pulsive high voltage is applied to the signal electrodes at a time slot during which a last group of the multiple lines including the virtual line are concurrently selected. As described above, the pulsive high voltage is imposed on the column signal electrodes dependent on a picture pattern, a frequency characteristic of the bias voltage imposed on the liquid crystal varies to thereby cause a transmittance fluctuation. Thus, a fifth object of the invention is to spread out the pulsive high voltage generated in the gray shading display by the pulse-height modulation so as to suppress variation of the transmittance due to the frequency characteristic of the liquid crystal.

DETAILED DESCRIPTION OF THE INVENTION

Figure 1:
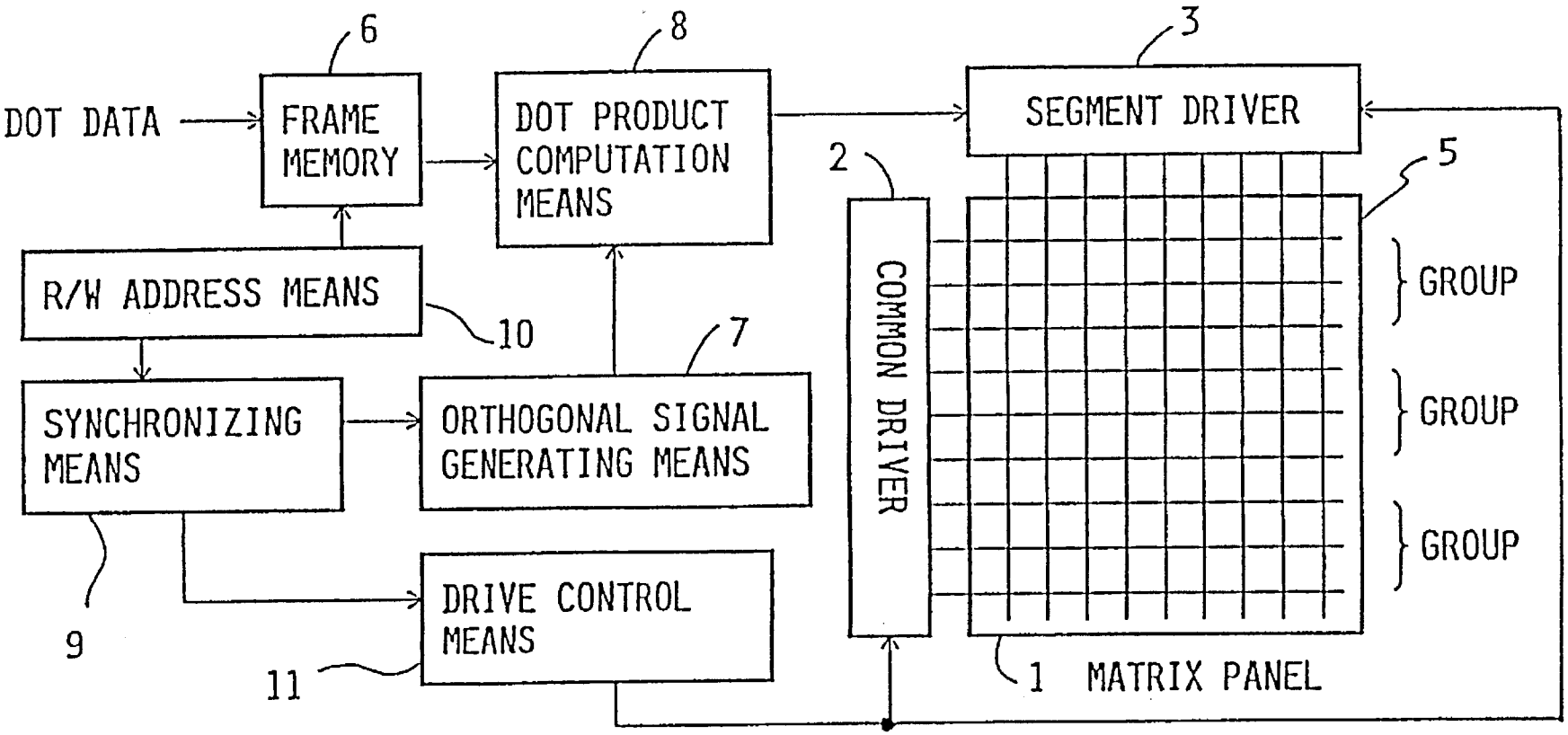
FIG. 1 a block diagram showing a basic construction of the inventive liquid crystal display device.

Referring to FIG. 1, description is given to a basic construction of the invention. As shown in the figure, the inventive liquid crystal display device is generally comprised of a matrix panel 1, a common driver 2, and a segment driver 3. The matrix panel 1 is constructed such that a liquid crystal layer is interposed between rows of scanning electrodes 4 and columns of signal electrodes 5. The liquid crystal layer may be composed o an STN liquid crystal. The common driver 2 is connected to drive the scanning electrodes 4. The segment driver 3 is connected to drive the signal electrodes 5.

In order to achieve the first object of the invention, the device includes a frame memory 6, orthonormal signal generating means 7, dot product computation means 8 and synchronizing means 9. The frame memory 6 holds inputted matrix dot data frame by frame. Each dot data represents picture data assigned to a pixel defined at an intersection between a row of the scanning electrode 4 and a column of the signal electrode 5. The orthonormal signal generating means 7 generates a set of orthonormal signals to sequentially feed a desired combination pattern thereof to the common driver 2, such that the rows of the scanning electrodes are selectively driven in group sequential manner according to the given combination pattern. In the schematic figure, three scanning electrodes are driven concurrently as a group. The dot product computation means 8 carries out specific dot product computation between a set of the dot data sequentially read out from the frame memory 6 and the set of the orthonormal signals transferred from the orthonormal signal generating means 7. The computed results are fed to the segment driver 3 to drive the column signal electrodes 5. The synchronizing means 9 synchronizes a reading timing of the dot data from the frame memory 6 with a signal transfer timing from the orthonormal signal generating means 7. The group sequential scanning is repeatedly carried out several times of frames by one cycle to thereby display a desired picture. The inventive liquid crystal display device further includes R/W address means 10 for controlling reading and writing of the dot data for the frame memory 6. The R/W address means 10 is controlled by synchronizing means 9 to feed a given reading address signal to the frame memory 6. In addition, drive control means 11 is included to feed a given clock signal to the common driver 2 and the segment driver 3 under the control of the synchronizing means 9.

Figure 2:
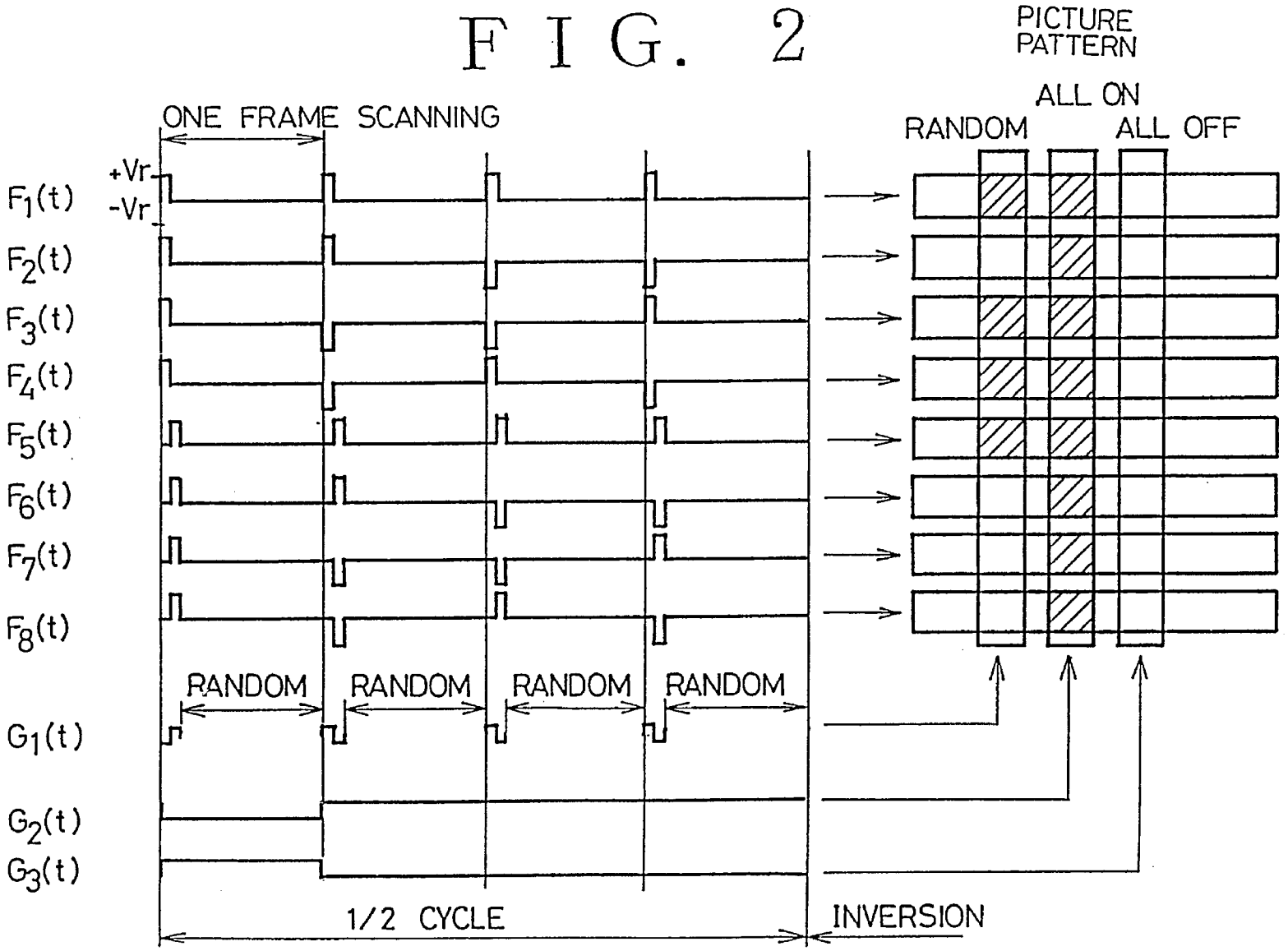
FIG. 2 is a timing chart showing one embodiment of a multiple line concurrent driving.

Hereinafter, description is given to the multiple line selection where four lines of the scanning electrodes are concurrently selected. FIG. 2 shows a waveform of the four line concurrent driving method. $F_1(t)$–$F_8(t)$ denote voltage waveforms applied to respective row scanning electrodes. $G_1(t)$–$C_3(t)$ denote voltage waveforms applied to respective column signal electrodes. The scanning signal waveform is set according to a Walsh function which is one of the complete orthonormal functions in "0" and "1" levels. The scanning waveform is set to "–Vr" corresponding to "V", set to "+Vr" corresponding to "1", and set to 0V during a nonselection period. Four lines are selected concurrently as a group such that each group is sequentially scanned from top to bottom of the display. Four times of the group sequential scanning corresponds to one period of the Walsh function to complete a first half cycle. In a next period, a second half cycle is carried out while the polarity of the signal is inverted to thereby remove a DC component.

On the other hand, each dot data $I_{ij}$ is set to "–1" for the ON state pixel and set to "+1" for the OFF state pixel where "i" denotes a row number of the matrix, and "j" denotes a column number of the matrix. Then, the column data signal $G_j(t)$ applied to each signal electrode is basically set by carrying out the following dot product computation:

$$G_j(t) = \frac{1}{\sqrt{N}} \sum_{i=1}^{N} I_{ij} \times F_i(t)$$

In the above computation, the summation is effected only for the selected lines since the scan signal voltage is set to "0" level in the nonselection period. Accordingly, in the concurrent selection of the four lines, the data signal can take five voltage levels. Namely, the data signal requires a certain number of voltage levels equal to "concurrently selected line numbers+one".

Figure 3:
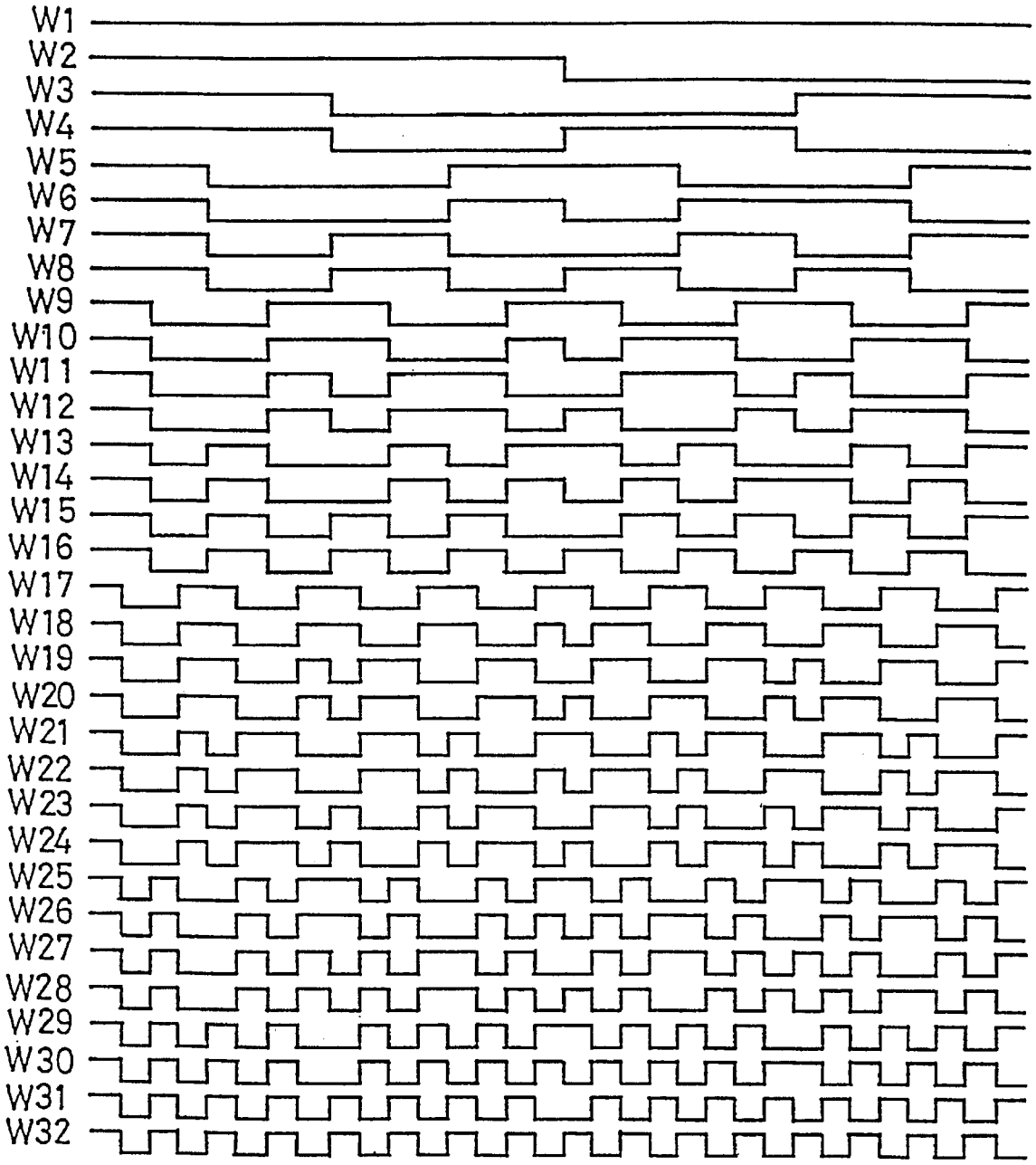
FIG. 3 is a waveform diagram showing an orthonormal set of Walsh functions.

FIG. 3 shows waveforms of Walsh functions of different orders. In case of the concurrent four-line selection, for example, Walsh functions of the first four orders may be utilized to form the set of the row scan signal waveforms. As understood from comparison between FIG. 2 and FIG. 3, the row scan signal $F_1(t)$ corresponds to the Walsh function W1 of the first order. The function W1 holds a high level throughout one period, hence the signal $F_1(t)$ contains a sequence of four pulses arranged 1, 1, 1, 1. The row signal $F_2(t)$ corresponds to the second order Walsh function W2. The function W2 has a high level in a first half of one period and a low level in a second half of one period. Accordingly, the signal $F_2(t)$ is composed of four pulses in the sequence of 1, 1, 0, 0. In similar manner, the row function $F_3(t)$ corresponds to the third order Walsh function W3 so that the four pulses are arranged in the sequence of 1, 0, 0, 1. Further, the row signal $F_4(t)$ corresponds to the fourth order Walsh function W4 so that the four pulses are arranged in the sequence of 1, 0, 1, 0. As understood from the above description, the set of the scan signals concurrently applied to one group of the scanning electrodes are represented by an adequate combination pattern of (1, 1, 1, 1), (1, 1, 0, 0), (1, 0, 0, 1) and (1, 0, 1, 0) based on the orthonormal relation. In the FIG. 2 case, the second group receives the set of the orthonormal signals $F_5(t)$–$F_8(t)$ having the same combination pattern. In similar manner, the third and further groups receive the set of the orthonormal signals having the same combination pattern.

Figure 4:
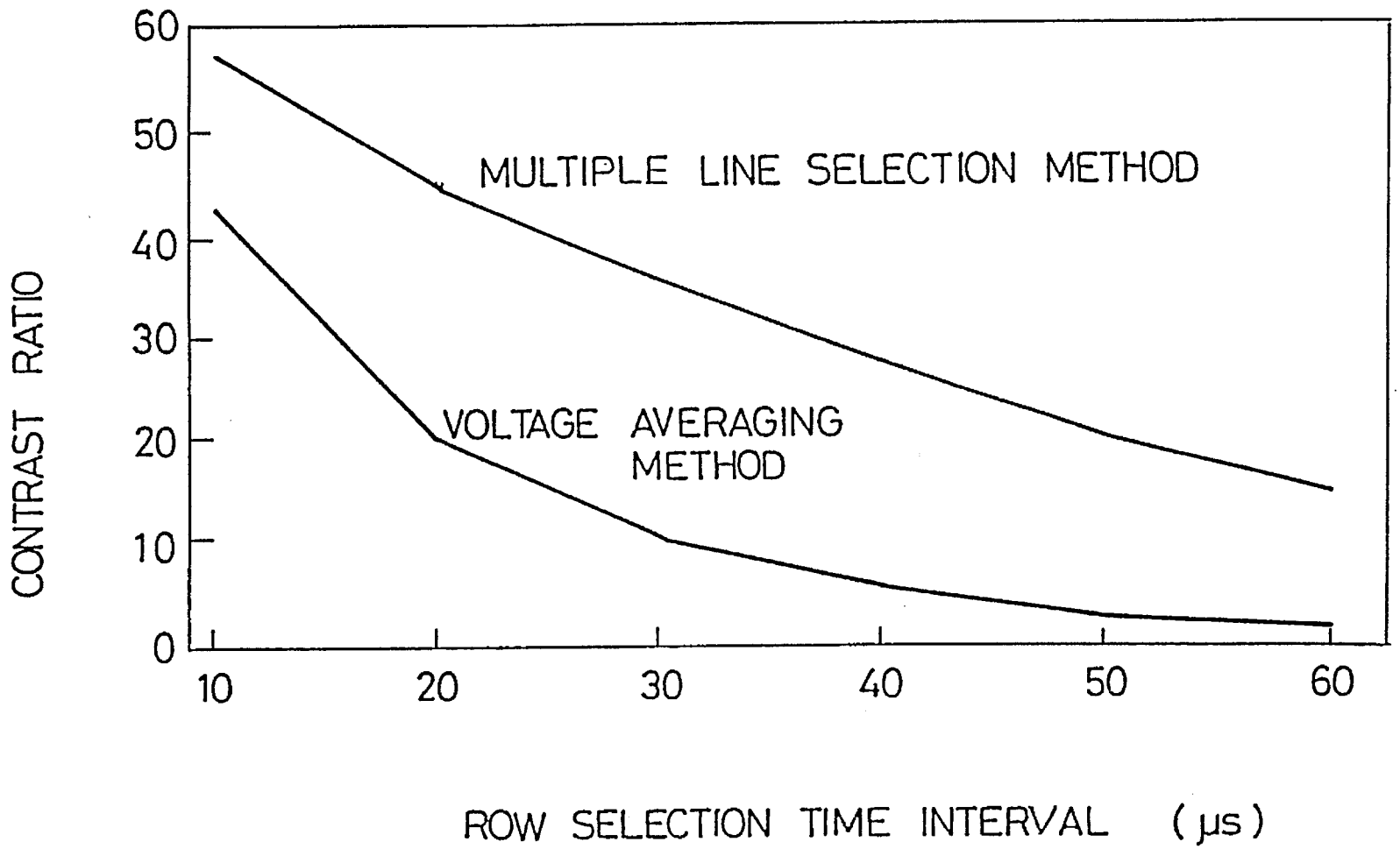
FIG. 4 is a graph showing a dependency of a contrast ratio on a row selection time interval of a liquid crystal panel.

As described above, according to the multiple line selection method, a pitch between adjacent high voltage pulses is reduced to achieve the same effect as the high frequency drive without reducing a pulse width. Further, a potential difference between the high voltage pulse and the bias voltage is reduced to raise the bias voltage without degradation of the ON/OFF selection ratio, thereby avoiding degradation of the contrast due to the frame response. FIG. 4 is a graph showing dependency of the contrast ratio on a row selection time interval of the scanning electrode. As seen from the graph, the contrast ratio of the multiple line selection method is improved as compared to the voltage averaging method. The multiple line selection method features suppression of the frame response in the fast drive liquid crystal display device, improvement in uniformity of the display quality, reduction of a supply voltage, removal of a DC component and so on.

Next, description is given to the solution for achieving the second object of the invention. Namely, in the multiple line selection method of the plain matrix type of the liquid crystal panel, the concurrently selected line numbers of each group is optimized so as to balance the withstand voltage between the segment driver and the common driver. In detail, the line number n of the scanning electrodes involved in one group is set around the square root value of the total scanning line number N. Generally, as the line number of the concurrently selected scanning electrodes in one group increases, the of the orthonormal signal is raised accordingly. Namely, a number of pulses within one cycle increases such that the pulse voltage is widely spread out so that each pulse height of the orthonormal signal is lowered. Consequently, as the number of the concurrently selected lines increases, the withstand voltage required in the common driver is lowered. On the other hand, as the concurrently selected line number increases, the dot product signal is complicated to raise a number of required voltage levels. Consequently, as the concurrently selected line number increases, the range of the dot product signal rises to thereby raise the withstand voltage required for the segment driver. Accordingly, the withstand voltages of the common and segment drivers have a reciprocal relation to each other with respect to the concurrently selected line number n. Accordingly, the concurrently selected line number n is optimized in the invention to balance the withstand voltages of the segment and common drivers with each other.

Next, description is given to the solution for achieving the third object of the invention. In the multiple line selection method, a multiple of the row lines are concurrently selected to effect the group sequential scanning from an upper side to a lower side of the display. In this operation, the phase of the row scan signal set applied to the concurrently selected scanning electrodes is shifted from the immediately preceding row scan signal set which has been applied to the preceding group of the concurrent scanning electrodes. By such a horizontal phase shift, the bias voltage applied to the liquid crystal is spread out rather than being concentrated into one frame period within a half cycle when all of the pixels are placed in either of an ON or OFF state. The phase shift may be sequentially controlled such that the last orthonormal signal set is phase-shifted at least one period from the first orthonormal signal set within one frame scan interval. Accordingly, it is not necessary to successively effect the phase shift between adjacent groups of the row lines, but the phase shift may be effected everytime after several groups are scanned to complete the one period phase shift within one frame scanning frame interval. The same is true when the display face is scanned from bottom to top reversely to the top-to bottom manner, or when the display face is scanned in a random manner. As described above, the contrast fluctuation occurs dependent on the picture pattern in the conventional multiple line selection method. In view of this, the set of the orthonormal signal waveforms is sequentially phase-shifted horizontally to level the optical response and to thereby suppress the frame response as well as to improve the contrast in the total ON or OFF state.

Further description is given to the solution for realizing the fourth object. In the multiple line selection method, normally each group of multiple lines is sequentially selected to scan the display face from top to bottom. This frame scanning from top to bottom is repeated several times to complete one cycle of the orthonormal function. In this operation, respective orthonormal waveforms applied to the concurrently selected multiple lines are interchanged with each other between a preceding cycle and a succeeding cycle so as to make uniform a frequency of the waveform applied to each line to thereby eliminate horizontal stripe shades appearing at a pitch identical to the width of the multiple lines. Optimally, the orthonormal waveforms are interchanged with each other such that the waveform is shifted vertically one line each cycle such as the second waveform is updated to the first waveform, the third waveform is updated to the second waveform and so on. Consequently, each line receives different orthonormal waveforms cycle to cycle to thereby make uniform the frequency distribution of the multiple selected lines. Alternatively, the highest frequency waveform and the lowest frequency waveform are simply interchanged to each other. Further, in order to average the frequency of the waveform applied to the respective scanning electrode, the interchanging may be carried out every several cycles rather than every one cycle. Moreover, the interchanging can be undertaken every half cycle if the waveforms are suitably arranged to avoid application of a DC a component to the liquid crystal. In addition, the above vertical shift can be effected when the display face is scanned from bottom to top or in random manner, in a similar manner to the forward scanning of the display face from top to bottom. In contrast to the conventional multiple line selection which generates the horizontal stripe shading at the width of the multiple lines, the waveforms of the row scan signals are interchanged according to a period of the orthonormal functions in the present invention so as to average the frequency of each row scan signal to thereby eliminate the horizontal stripe shadings.

Lastly, description is given to the solution for realizing the fifth object of the invention. Namely, in case that the gray shading is effected by the pulse-height modulation in the multiple line Selection method, a virtual line is not provided at an order of N+1, but each virtual line is provided for each group of the multiple lines so as to spread out an effective voltage throughout the column signal waveforms to thereby avoid application of a pulsive high voltage to the column signal electrodes. In practice, the virtual data $V_{(L+1)j}$ is computed according to the following first equation, and the column data signal $G_j(t)$ is computed according to the following second equation. Namely, the virtual data $V_{(L+1)}$ is added whenever a group of multiple lines is concurrently selected to determine the voltage level of the column signal lines. In this computation, the value of $V_{(L+1)}$ becomes $\sqrt{L}/N$ times as that of $V_{(N+1)}$ in the order of $\sqrt{L}$ to thereby avoid application of an excessively high voltage.

$$V_{(L+1)j} = \left( \frac{L}{\sqrt{N}} \cdot \left( N - \sum_{m=1}^{N} I^2 mj \right) \right)^{1/2}$$

$$G_j(t) = \frac{1}{\sqrt{N}} \sum_{i=1}^{N} I_{ij} F_i(t) + \frac{1}{\sqrt{N}} \sum_{k=1}^{N/L} V_{(N+1)j} F_k(t)$$

In contrast to the conventional gray shading of the multiple line selection which suffers from a transmittance fluctuation dependent on a picture pattern, the virtual data is spread over the groups of the multiple lines so that the waveform actually applied to the liquid crystal is dominated by the frequency of the row scan signals to thereby make the display uniform.

Further, in providing the virtual line for each group of the multiple lines, the effective voltage concentrated to the line of N+1 order may be computed whenever the L number of lines are selected so as to spread over the column waveforms to thereby avoid application of a pulsive high voltage to the column signal electrodes. In such a case, the virtual data $V_{kj}$ is computed according to the following first equation, and the data signal $G_j(t)$ is computed according to the following second equation. Namely, the virtual data $V_{kj}$ is calculated whenever the group of the multiple lines is selected, and the calculated result is added to determine the voltage level of the column signal electrodes. In this case, the value of $V_{kj}$ reaches only $\sqrt{L}$ at maximum to thereby avoid application of an excessively high voltage.

$$V_{kj} = \left( L - \sum_{m=1}^{N} I^2 (k * L + m)_j \right)^{1/2} \qquad k = i/L$$

$$G_j(t) = \frac{1}{\sqrt{N}} \sum_{i=1}^{N} I_{ij} F_i(t) + \frac{1}{\sqrt{N}} \sum_{k=1}^{N/L} V_{kj} F_k(t)$$

In contrast to the conventional gray shading of the multiple line selection which suffers from a transmittance fluctuation dependent on a picture pattern, the virtual data is dividedly applied whenever the multiple line group is selected according to the invention such that the waveform actually applied to the liquid crystal is dominated by the frequency of the row scan signal to thereby make uniform the display regardless of the picture pattern.

As described above, the virtual data $V_{kj}$ is calculated whenever the multiple line group is selected, and the calculated result is added to determine the voltage level of the calculated result is added to determine the voltage level of the column signal electrodes. In this computation, the value of $V_{kj}$ may be calculated according to the following equation based on the dot data assigned to the L number of lines which have been selected in a preceding cycle, rather than in the current cycle.

$$G_j(t) = \frac{1}{\sqrt{N}} \sum_{i=1}^{N} I_{ij} F_i(t) + \frac{1}{\sqrt{N}} \sum_{k=1}^{N/L} V_{(k-\Lambda)j} F_k(t)$$

The virtual data $V_{kj}$ is calculated according to the dot data of the L number of lines, which has been retrieved from the frame memory at an immediately preceding or a further preceding cycle, hence the computation time is prolonged to simplify the construction of a drive circuit.

According to the first aspect of the invention, the frame memory, the orthonormal signal generating means, the dot product computation means and the synchronizing means are provided for practically and efficiently driving the plain matrix type of the liquid crystal panel according to the multiple line selection method. The frame memory stores the inputted dot data of each frame. The orthonormal signal generating means generates a set of orthonormal signals, and sequantially feeds a desired combination pattern of the orthonormal signals to the common driver so as to select the row scanning electrodes in group sequential manner according to the combination pattern. The dot product computation means carries out the dot product computation of the dot data set and the orthonormal signal set. The computed results are fed to the segment driver to drive the signal electrodes. By such as construction, the group sequential scanning is repeated several times within one cycle to display a desired picture.

According to the second aspect of the invention, the common and segment drivers operate based on the dot data to drive the matrix panel having a liquid crystal layer interposed between rows of the scanning electrodes and columns of the signal electrodes. In this operation, a set of the orthonormal signals is successively fed to the common driver to drive the rows of the scanning electrodes in group sequential manner. Further, the segment driver receives the dot product signal obtained by the dot product computation of the dot data set and the orthonormal data set so as to drive the columns of the signal electrodes in synchronization with the group sequential scanning. In this case, the line number of the scanning electrodes involved in one group is optimized to balance the withstand voltage between the common and segment drivers. In detail, the line number n of the concurrently selected scanning electrodes in one group is set in the vicinity of the root square value of the total line number N.

According to the third aspect of the invention, instead of applying the set of the orthonormal signals to all of the groups in the fixed phase relation within one frame period, the phase of the orthonormal signals is shifted horizontally everytime the group of the multiple lines is concurrently selected. Such a horizontal shift can avoid concentration of the bias voltage applied to the liquid crystal layer in a nonselection interval of all ON or all OFF state, into one frame period within a half cycle. The phase shift is conducted such that the orthonormal functions determining the scanning signal waveforms are shifted at least one period within one frame scanning period. By such a manner, the phase of the waveforms applied to the scanning electrodes is shifted from that of the precedingly applied waveforms so as to suppress contrast variation dependent on a picture pattern as well as to suppress the frame response.

According to the fourth aspect of the invention, the waveforms assigned to the multiple concurrent lines are interchanged with one another every cycle so as to suppress a horizontal stripe shades appearing of a span of the concurrent lines to thereby make uniform the display face. In the regular multiple line selection method, the groups of the multiple lines are scanned from top to bottom of the display face, and this vertical scanning is repeated several times to complete one cycle of the orthonormal function set. In this operation, the scan signals applied to the concurrently selected row scanning electrodes are interchanged with one another between preceding and succeeding cycles to thereby average the frequency of the waveforms applied to the respective lines to eliminate the horizontal stripe shade.

According to the fifth aspect of the invention, in the gray shading display using the pulse-height modulation, rather than providing a single virtual line at a line of N+1 order, each virtual line is provided to the respective group of the multiple concurrent lines so as to spread out the effective voltage assigned to the N+1 order line throughout the waveform to thereby avoid application of a pulsive high voltage to the signal electrode. Accordingly, the high voltage pulse is applied only to the scanning electrodes, regardless of the picture pattern so as to make uniform the display face. Further, the virtual dot data assigned to the virtual line is computed everywhen the multiple concurrent line group is scanned to thereby avoid application of a pulsive high voltage to the signal electrode line. In this case, the virtual dot data may be calculated according to the past actual dot data rather than the present actual dot data so as to achieve faster operation and simplification of the drive circuit.

Figure 5A:
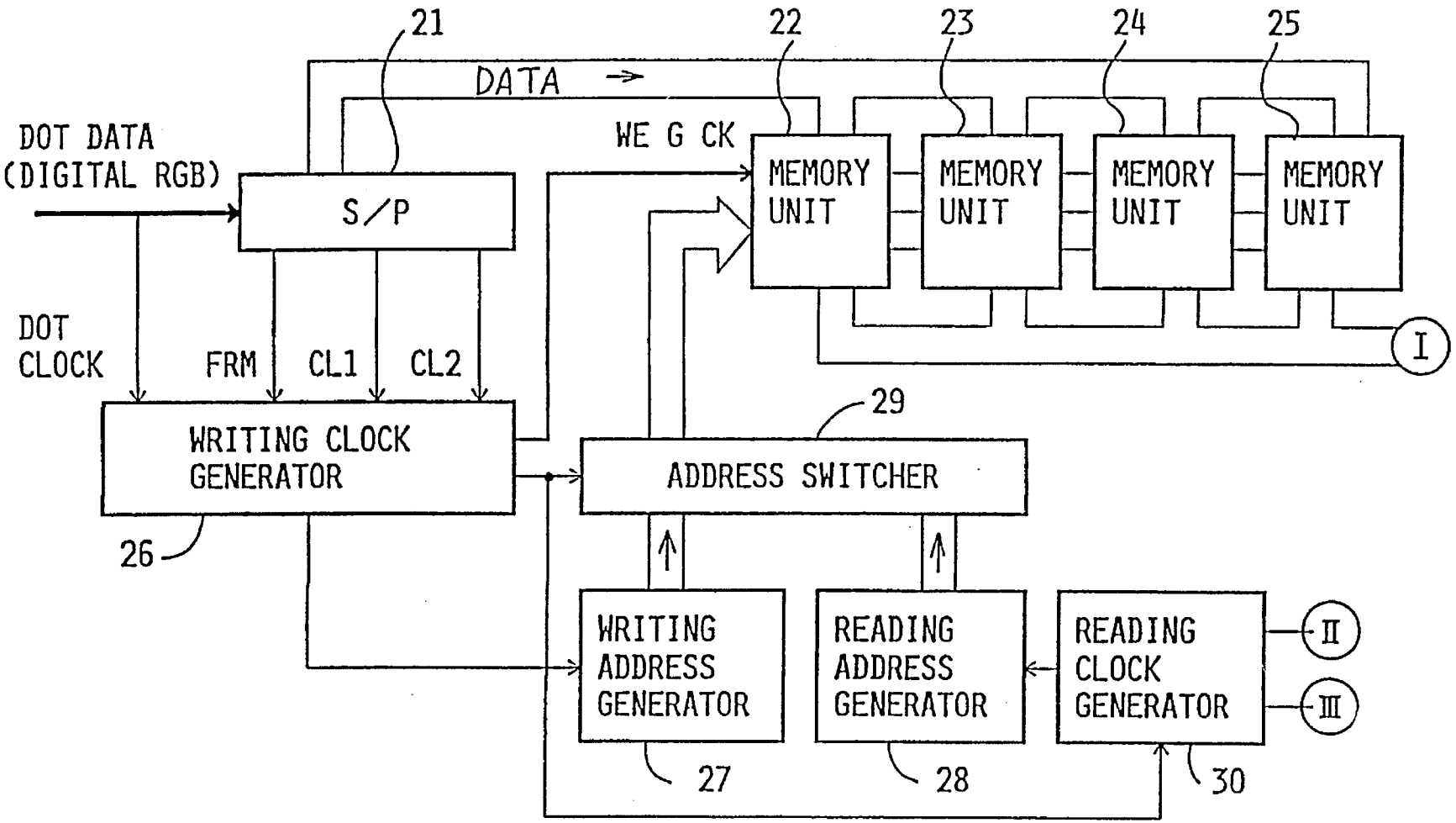
FIGS. 5A and 5B are a circuit diagram showing a detailed construction of a drive circuit of the liquid crystal display device shown in FIG. 1.
Figure 5B:
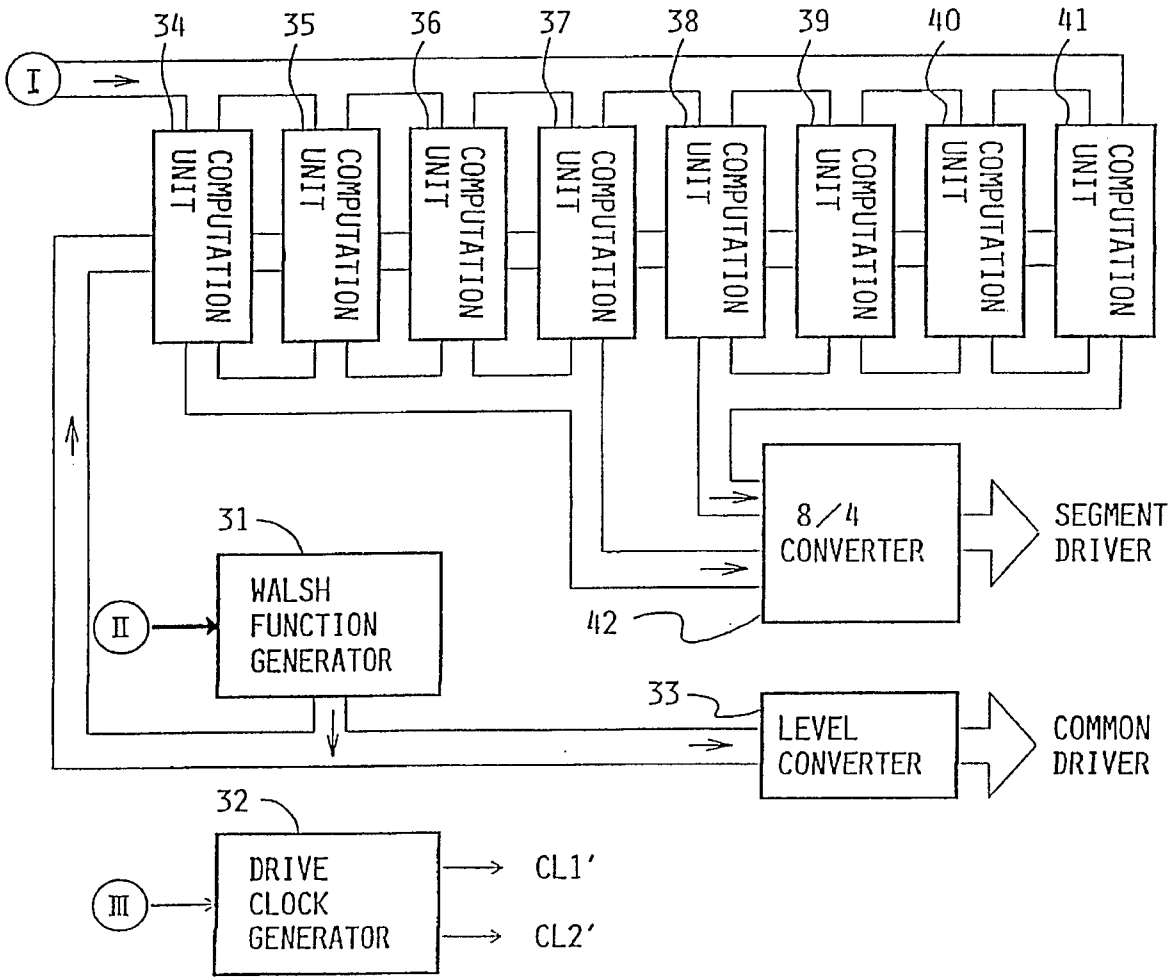

Hereinafter, various preferred embodiments of the present invention will be described in detail with reference to the drawings. FIGS. 5A and 5B are a detailed circuit diagram showing a first embodiment which is constructed to practice the basic construction illustrated by FIG. 1. As shown in FIG. 5A, the present embodiment is provided with a serial/parallel converter (S/P) 21 for converting an inputted serial dot data into a parallel dot data composed of eight bits. The dot data is given in the form of a digital RGB signal. A plurality of memory units 22–25 are connected to the S/P converter 21. Each memory unit corresponds to a row of the matrix so as to record the dot data in the sequence of eight-bit values. For example, first memory unit 22 successively registers eight bits of the dot data assigned to the first row. Similarly, the second memory unit 23 successively receives eight bits of the dot data assigned to the second row. In such a manner, the plurality of memory units 22–25 correspond to the frame memory 6 of FIG. 1. A writing clock generator 26 receives a dot clock as well as a frame signal FRM and clock signals CL1, CL2 from the serial/parallel converter 21 so as to feed to the memory units those of a writing signal WE, a writing gate signal G and a reading clock signal CK. The clock signal CL1 corresponds to the bit sequence of the serial dot data, and the other clock signal CL2 corresponds to each parallel set of eight bits. Further, a pair of writing and reading address generators 27, 28 are connected to the memory units 22–25 through an address switcher 29. The writing address generator 27 is controlled by the writing clock generator 26. Those of the above mentioned writing clock generator 26, writing address generator 27, reading address generator 28 and address switcher 29 correspond to the R/W address means 10 of FIG. 1. Further, the reading address generator 28 is controlled by a reading clock generator 30, which corresponds to the synchronizing means 9 of FIG. 1.

As shown in FIG. 5B, a Walsh function generator 31 is connected to the reading clock generator 30. This Walsh function generator 31 corresponds to the orthonormal signal generating means 7 of FIG. 1. Further, a drive clock generator 32 is controlled by the reading clock generator 30 to output certain clock signals CL1' and CL2'. These clock signals CL1' and CL2' are utilized to control a segment driver and a common driver. Accordingly, the drive clock generator 32 corresponds to the drive controlling means 11 of FIG. 1. The common driver is connected to an output terminal of the Walsh function generator 31 through a level converter 33. Lastly, eight computation units 34–41 are connected to output terminals of the memory units 22–25 as well as to the output terminal of the Walsh function generator 31. These eight computation units 34–41 correspond to respective ones of the parallel eight bits of the dot data. For example, the first computation unit 34 carries out dot product computation for the first column of the signal electrode to form a corresponding data signal. Similarly, the second computation unit 35 carries out the dot product computation with respect to the second column of the signal electrode to form a corresponding data signal. Further in a similar manner, the eighth computation unit 41 carries out the dot product computation for the eighth column of the signal electrode to form a corresponding data signal. By such a manner, the thus formed data signals of the eight columns are transferred to the common driver through an ¾ converter 92. The segment driver adopted in this embodiment has a capacity effective to receive a 3-bit data signal per pixel to output selectively eight voltage levels at most to the matrix panel. As described above, the multiple selection drive of the four concurrent lines needs five voltage levels of the signal waveform, hence the adopted segment driver has a sufficient drive capacity. However, the driver can receive at most three bits ×4 number of input data at once. Consequently, the data signal of four dots is transferred to the segment driver at once through the ¾ converter 42. Further, the common driver has the same structure as that of the segment driver in this embodiment.

Figure 6:
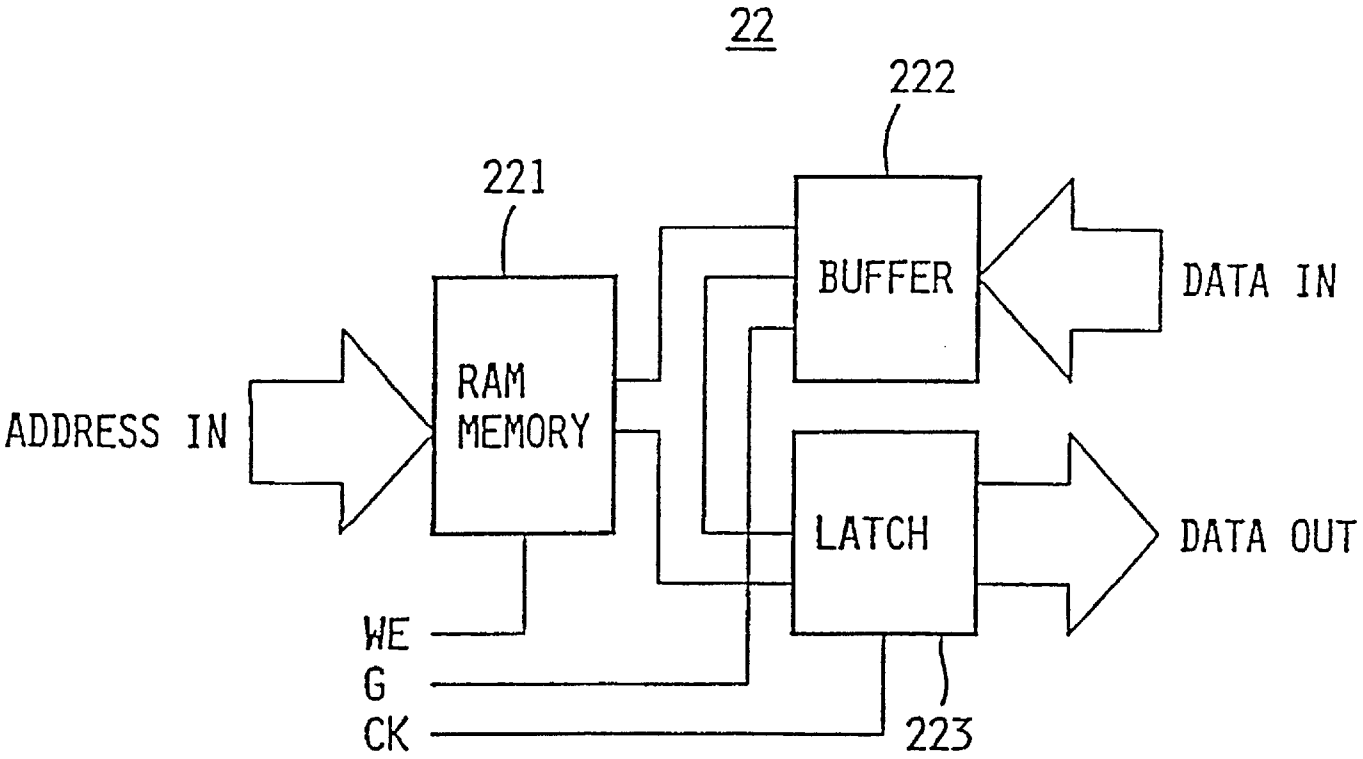
FIG. 6 is a circuit diagram showing a detailed construction of a memory unit contained in the FIG. 5 drive circuit.

Hereinafter, the detailed description is given to the operation of the various parts of the circuit shown by FIGS. 5A and 5B with reference to FIGS. 6–8. FIG. 6 is a schematic block diagram illustrating construction and operation of the individual memory unit. FIG. 6 examplifies the first memory unit 22 which contains a RAM memory 221. This RAM memory 221 registers eight bits of dot data assigned to the first row. An input buffer 222 is provided to temporarily store the dot data inputted as a set of eight bits at once from the serial/parallel converter. The stored dot data is registered into a given address location of the RAM memory 221 according to a writing address signal fed from the writing address generator through the address switcher. Further, an output latch 223 is provided to latch successively eight bits of the dot data retrieved from the RAM memory 221 so as to sequentially transfer the dot data to the computation units. In this operation, the RAM memory 221 is accessed to read out the dot data by a reading address signal fed from the reading address generator through the address switcher. The input buffer 222 is controlled by the writing gate signal G fed from the writing clock generator, the output latch 223 is controlled by the clock signal CK, and the RAM memory 221 is controlled in response to the writing command signal WE.

Figure 7:
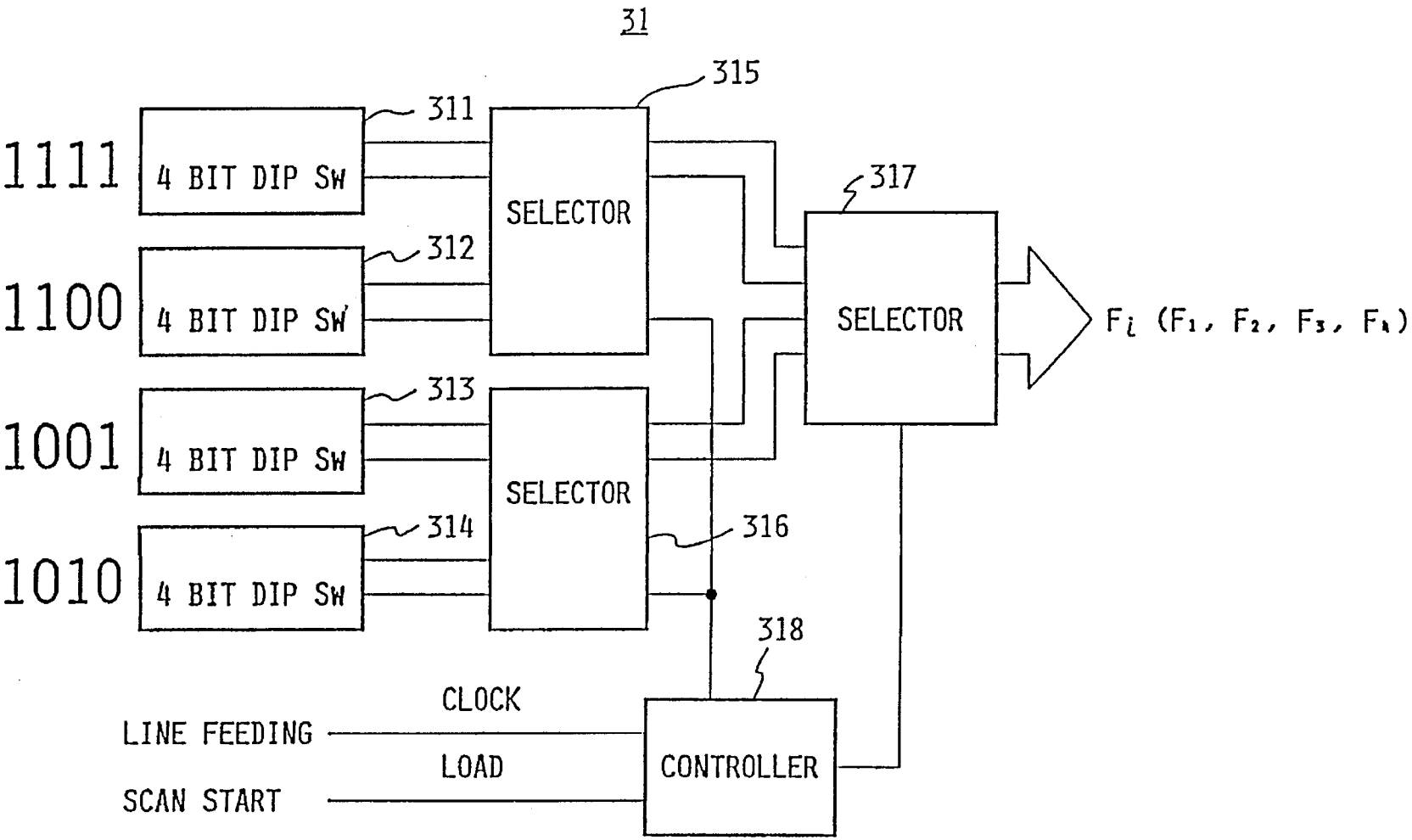
FIG. 7 is a circuit diagram showing Walsh function generator contained in the FIG. 5 drive circuit.

FIG. 7 is a circuit diagram illustrating the detailed structure and operation of the Walsh function generator 31. This function generator 31 contains four 4-bit dip switches (Sw) 311–314, three number of selectors 315, 316 and 317, and a controller 318. The four dip switches 311–314 memorize a desired combination pattern which satisfies the orthonormal relation. This combination pattern is illustrated in the FIG. 2 timing chart. The first dip switch 311 is set with the combination pattern, 1, 1, 1, 1 for the first frame scanning. Namely, all of the row scan signals $F_1$, $F_2$, $F_3$ and $F_4$ have a pulse of the logical level "1" in the first frame scanning.

The second dip switch 312 is set with the combination pattern 1, 1, 0, 0 for the second frame scanning. Namely, the second frame scanning is undertaken under the condition $F_1=1$, $F_2=1$, $F_3=0$ and $F_4=0$. Similarly, the third dip switch 313 is set with the combination pattern 1, 0, 0, 1 for the third frame scanning. Namely the third frame scanning is conducted under the condition $F_1=1$, $F_2=0$, $F_3=0$ and $F_4=1$. The fourth dip switch 314 is set with the combination pattern 1, 0, 1, 0 for the fourth frame scanning. Namely, the fourth frame is conducted under the condition $F_1=1$, $F_2=0$, $F_3=1$ and $F_4=0$. The three selectors 315, 316 and 317 are controlled by the controller 318 so as to select one of the four dip switches for each scanning operation. The controller 318 switches the respective selectors in response to a row line feeding signal (Clock) and a scan start signal (Load). At the first group scanning, the first dip switch 311 is selected by means of the selectors 315 and 317 to output the given orthonormal signals $F_1$, $F_2$, $F_3$ and $F_4$. These four orthonormal signals are fed to the common driver in the form of the row scanning signals by means of the level converter. The level converter converts the orthonormal signal of 0/1 level into the corresponding row scanning signal of +Vr/0/−Vr level. These orthonormal signals are also transferred to the computation units. In the first frame scanning, the four orthonormal signals having the combination pattern 1, 1, 1, 1 are outputted in group sequential manner. When the operation shifts to the second frame, the second dip switch 312 is selected by means of the selectors 315 and 317 to output the four orthonormal signals $F_1$, $F_2$, $F_3$ and $F_4$ having the given combination pattern 1, 1, 0, 0. In similar manner, the third dip switch 313 is connected to the output terminal by means of the selectors 316 and 317 in the third frame. Further, the fourth dip switch 314 is connected to the output terminal by means of the selectors 316 and 317 in the fourth frame.

Figure 8:
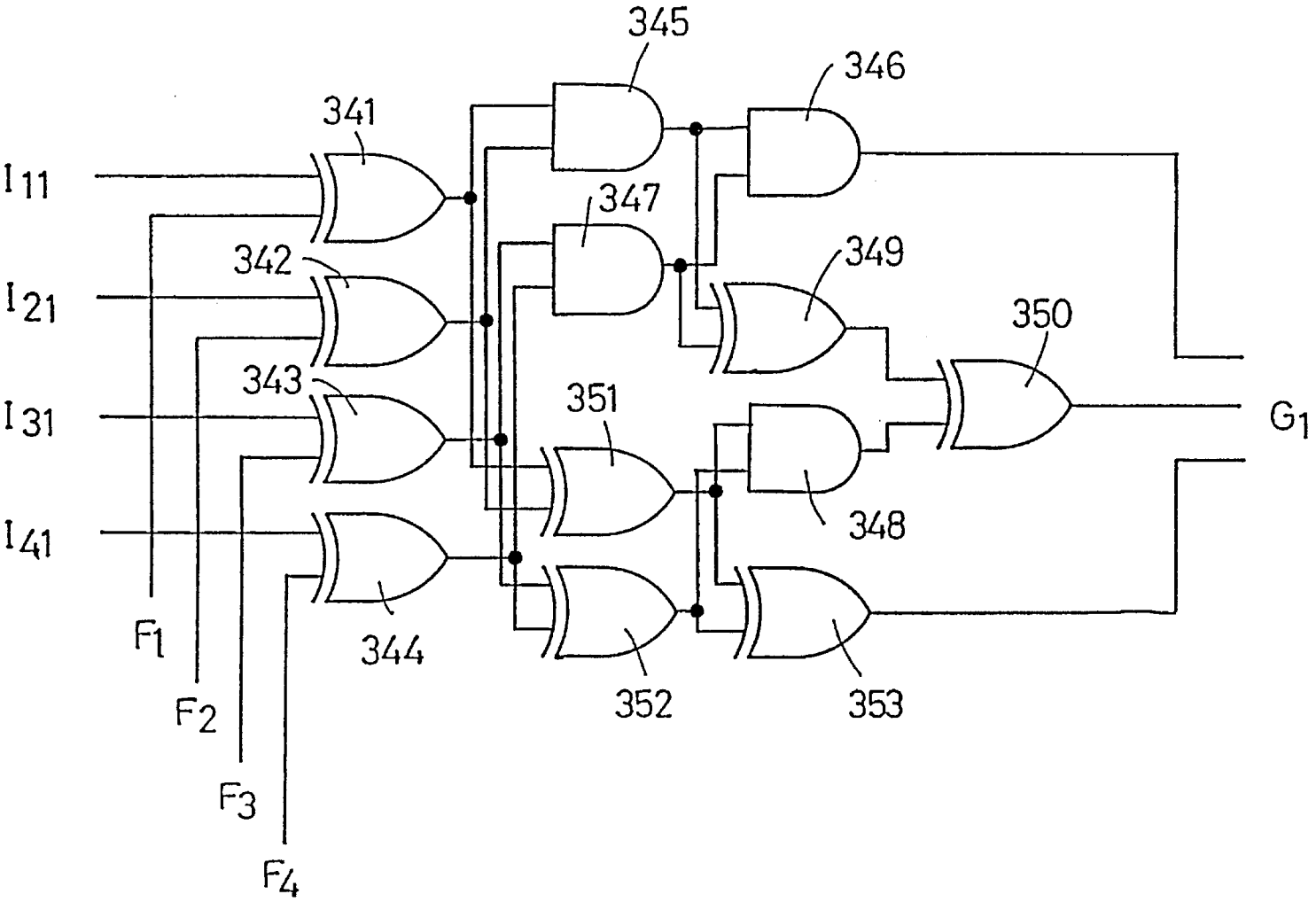
FIG. 8 is a circuit diagram showing a detailed construction of a computation unit contained in the FIG. 5 drive circuit.

FIG. 8 is a circuit diagram showing the structure and operation of the individual computation unit. FIG. 8 exemplifies the first computation unit 34. This computation unit 34 contains four exclusive OR operators (XOR) 341–344. The first XOR 341 multiples the orthonormal function $F_1$ assigned to the first row of the scanning electrode with the dot data $I_{11}$ assigned to a pixel at the intersection between the first row of the scanning electrode and the first column of the signal electrode. Similarly, the second XOR operator 342 multiples with each other the orthonormal function $F_2$ assigned to the second row and the dot data $I_{21}$ assigned to the pixel of the second row and the first column. The third XOR operator 343 multiples with each other the orthonormal function $F_3$ assigned to the third row and the dot data $I_{31}$ assigned to the pixel of the third row and the first column. Lastly, the fourth XOR operator 344 multiples with each other the orthonormal function $F_4$ assigned to the fourth row and the dot data $I_{41}$ assigned to the pixel of the fourth row and the first column. These four XOR operators are connected to a succeeding summation unit comprised of four logical AND operators 345–348 and five logical exclusive OR operators 349–353, such that all of the four multiplied results are summed altogether to form a data signal $G_1$ assigned to the first column of the signal electrode. In similar manner, the second computation unit 35 shown in FIG. 5 forms a data signal $G_2$ assigned to the second column of the signal electrode. The data signal may have five voltage levels, hence the digital form thereof is represented by 3-bit data as shown in FIG. 8. This 3-bit data can be directly fed to the segment driver.

Next, the description is-given to the horizontal shift mode of the multiple line selection method. As long as the orthonormal relation is maintained in the multiple line selection drive, the voltage waveforms applied to the scanning electrodes may have various combination patterns. However, in the combination pattern indicated by FIG. 2, all of the multiple concurrent lines receive +Vr or −Vr in one frame during each half cycle. For example, in the first frame of the first half cycle, all the concurrent row lines receive the pulse of +Vr. Similarly, all the concurrent row lines receive the pulse of −Vr in the first frame of the second half cycle. On the other hand, the voltage waveforms applied to the column signal electrodes are computed according to the aforementioned dot product equation based on the dot data. Accordingly, if the matrix dot data represents a random picture pattern, the bias voltage is randomly applied in the nonselected period during the half cycle. However, if the picture pattern is placed in either of the all ON state and all OFF state, the bias voltage of the nonselection period is concentrated into a certain scanning period in which all the concurrent lines receive +Vr or −Vr. For this, the optical response is fluctuated to cause contrast variation dependently on the picture pattern.

Figure 9:
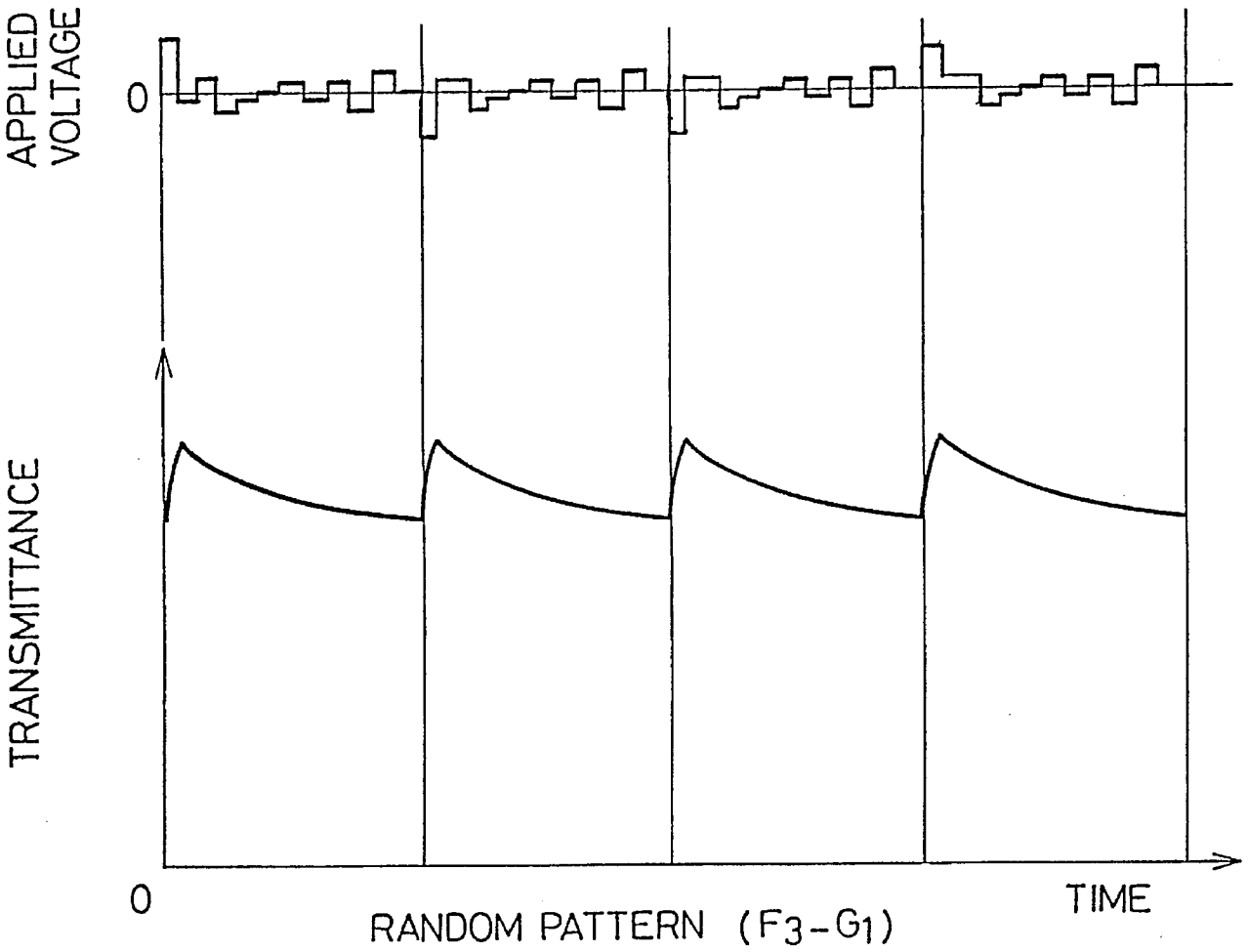
FIG. 9A and 9B are a group showing an optical response of the plain matrix type liquid crystal panel.
Figure 9:
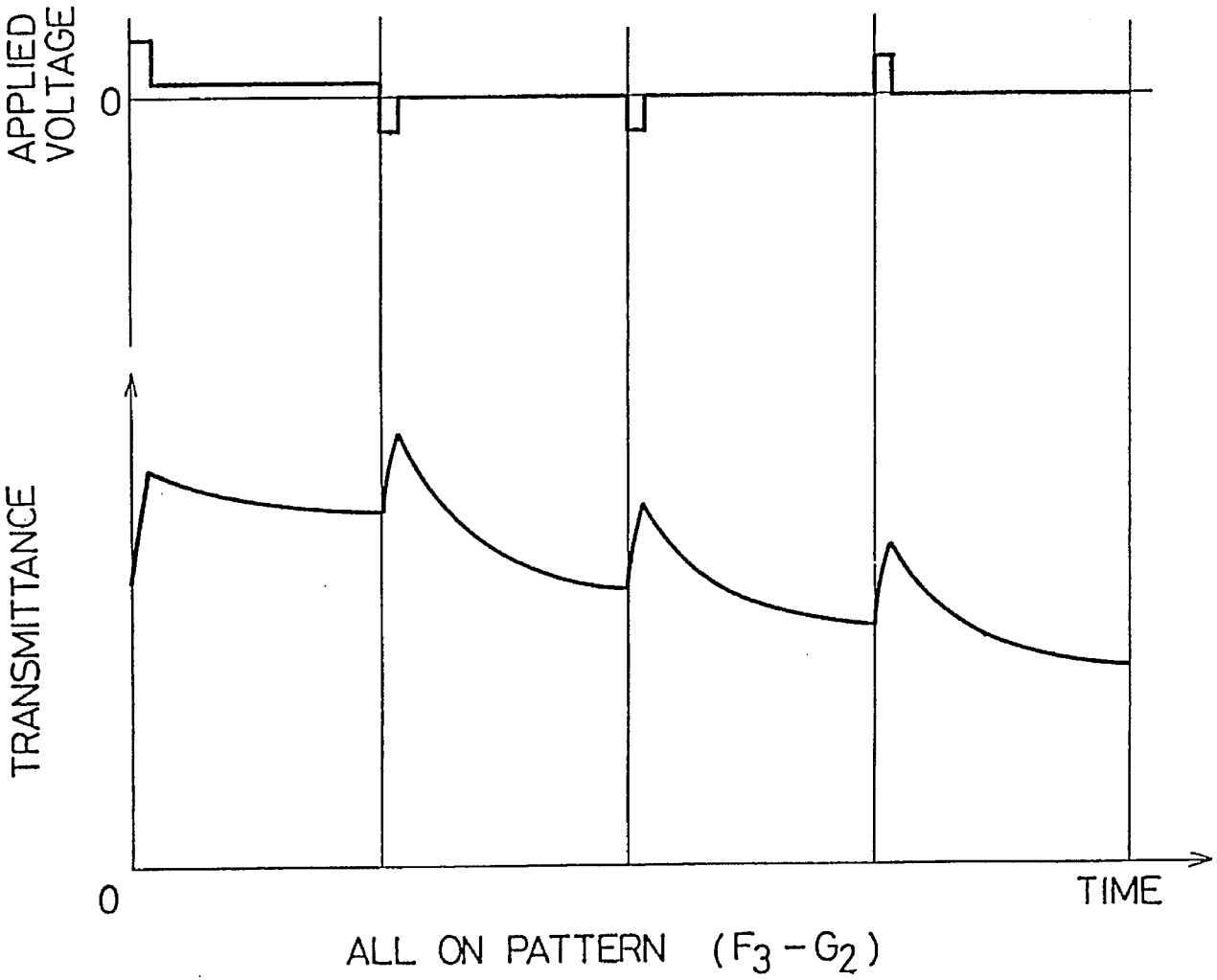

FIGS. 9A and 9B illustrate how the contrast variation occurs dependently on the picture pattern. These graphs schematically represent the optical response and the voltage waveform actually applied to the liquid crystal in the four line concurrent selection mode. The FIG. 9A graph corresponds to a random picture pattern, and the FIG. 9B graph corresponds to an all ON picture pattern. As seen from these groups, the bias voltage of the nonselection interval is concentrated into the first frame period to thereby generate contrast fluctuation in the all ON picture pattern.

The horizontal shift drive is effective to remove the above noted drawback. In the multiple line selection method, each group of the multiple lines is sequentially selected to scan the display face from top to bottom. In this operation, the phase of the scanning signal waveforms applied to the group of the multiple lines is shifted from that of the preceding scanning signal waveforms applied to the just preceding group of the multiple lines. By such an operation, the bias voltage applied to the liquid crystal during the nonselection period is spread out without being concentrated into one frame interval within a half cycle. This phase shift is effected such that the combination pattern of the orthonormal waveform set is phase-shifted at least one period within the one frame scanning interval. Accordingly, it is not necessary to effect the phase shift successively between the adjacent groups, but the phase shift may be effected everytime several groups are successively selected so as to complete one period shift within the one frame scanning interval. Further, the phase shift may be applied in a similar manner to the case where the display face is scanned in reverse manner from bottom to top, or in a random manner. The conventional multiple line selection uses the combination pattern of the orthonormal function set fixed throughout one frame interval, resulting in the contrast fluctuation, whereas the inventive method horizontally shifts the phase of the waveforms of the scanning signals so as to make uniform the optical response to thereby suppress the frame response in the all ON or OFF state, and concurrently to improve the contrast.

Figure 10:
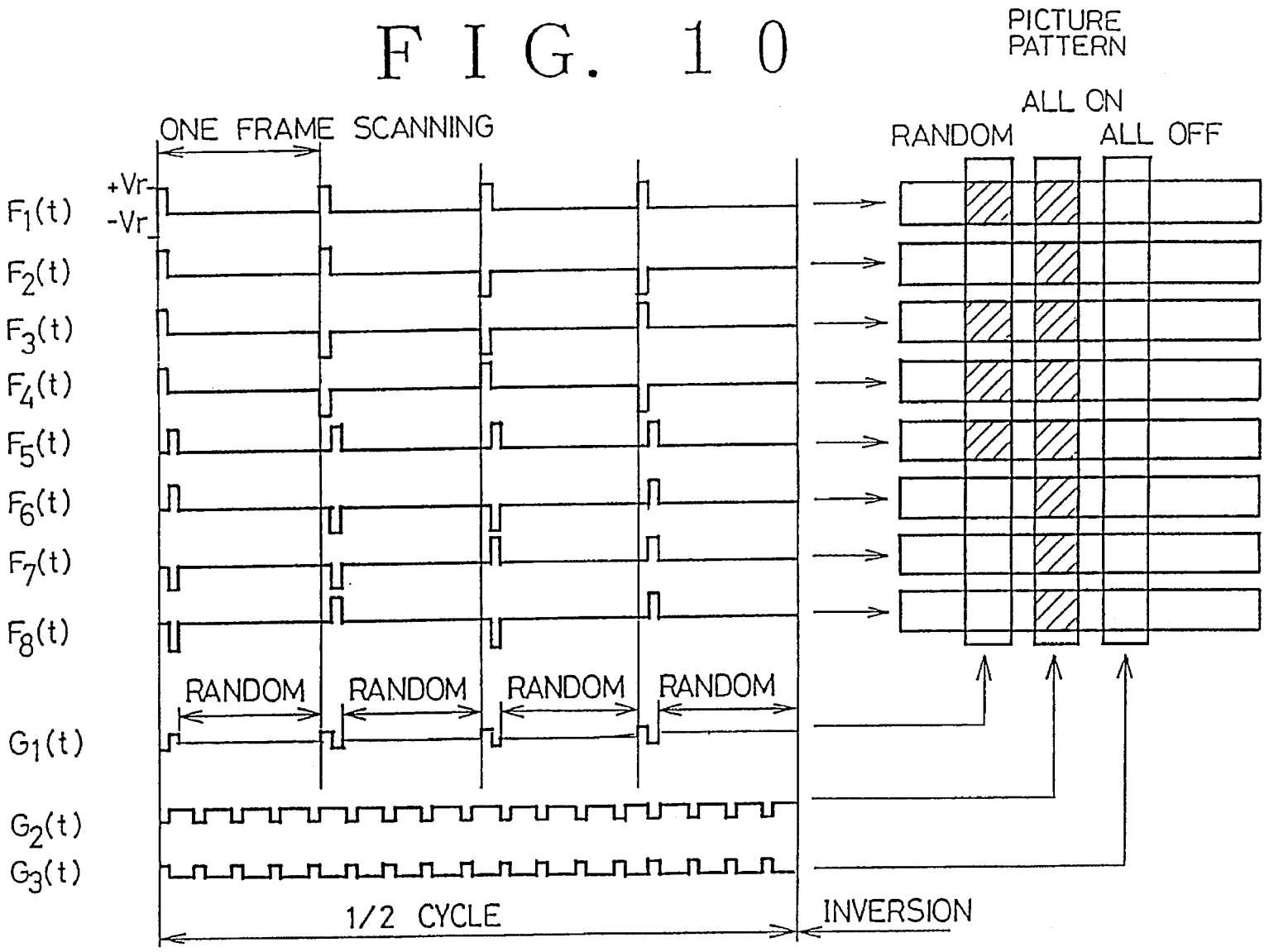
FIG. 10 is a timing chart showing the multiple line concurrent driving according to a horizontal shift method.

FIG. 10 shows one example of the horizontally phase-shifted waveforms. In the concurrent selection of four lines, the waveforms of the scan signals are arranged based on the Walsh functions such that the set of the four orthonormal waveforms is successively phase-shifted whenever each group of four concurrent lines is selected. In the FIG. 10 timing chart, $F_i(t)$ denotes each scan signal waveform. Each set of four lines is selected in group sequential manner to scan the display face from top to bottom. In the first frame scanning, the orthonormal signals $F_1$, $F_2$, $F_3$ and $F_4$ are set to +Vr, +Vr, +Vr and +Vr, respectively. The next set of $F_5$, $F_6$, $F_7$ and $F_8$ are set to +Vr, +Vr, −Vr and −Vr, respectively, which are shifted by one phase from the preceding set. In similar manner, the orthonormal signals after $F_8$ are also phase-shifted sequentially. On the other hand, the respective column signal electrodes are applied with the data signals $G_1(t)$, $G_2(t)$, $G_3(t)$, - - - , which are computed according to the aforementioned dot product equation. In contrast to the conventional data signal $G_2(t)$ in the all ON state and the conventional data signal $G_3(t)$ in the all OFF state where the voltage applied to the signal electrode is concentrated into the first frame interval, the inventive method features that the bias voltage is applied in every frame period to spread out uniformly throughout the half cycle.

Figure 11:
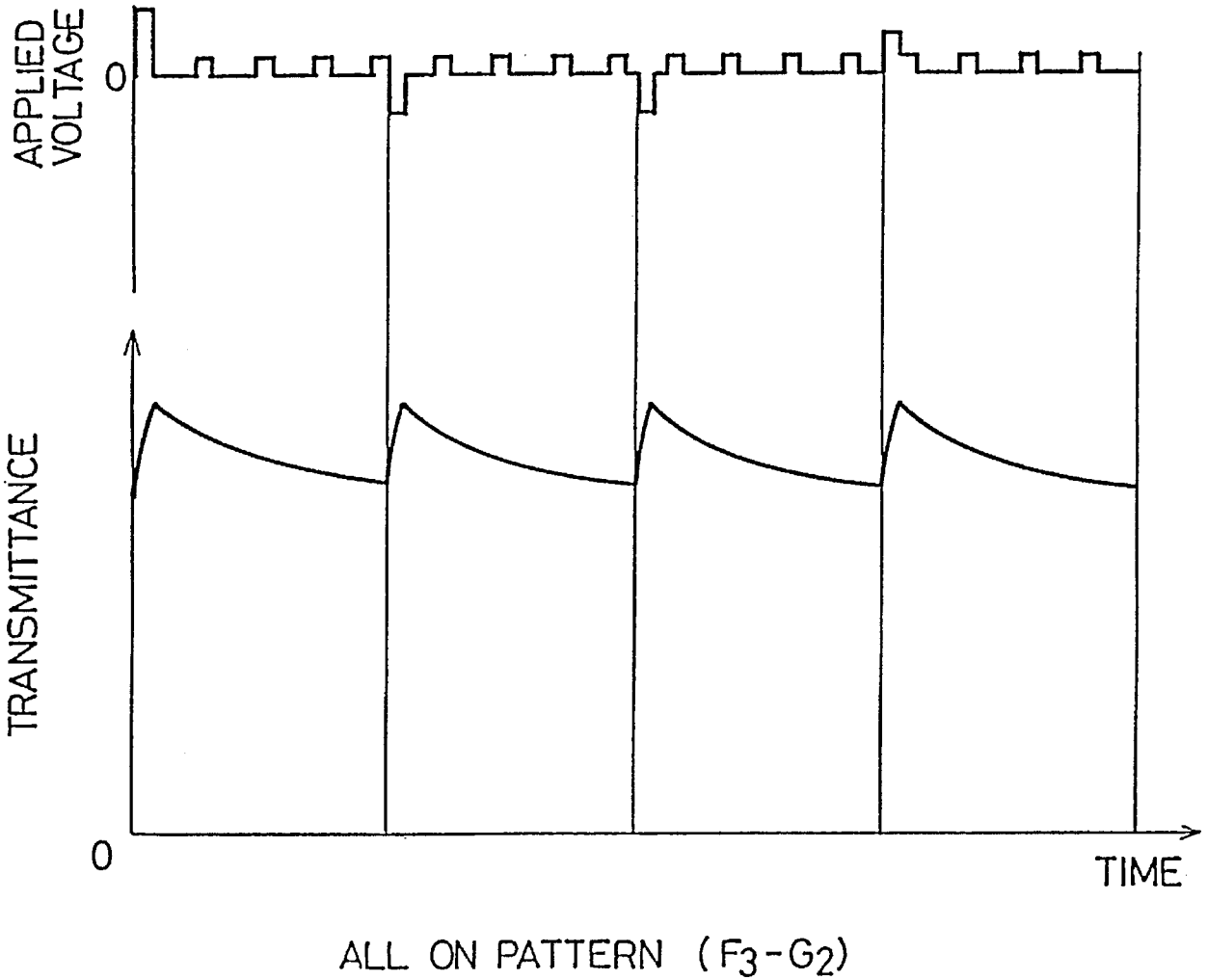
FIG. 11 is a group showing an optical response of the liquid crystal panel.

FIG. 11 shows a voltage waveform applied to the liquid crystal layer under the all ON state. In contrast to the FIG. 9B graph, the fluctuation of the optical response is eliminated so that the transmittance resembles that of the random pattern shown in FIG. 9A. As described above, the horizontal shift drive method can prevent gradual depression of the optical transmittance at the liquid crystal in response to the periodic frame scanning, thereby stably maintaining the high contrast level. Further, the fluctuation of the transmittance in the all ON state can be suppressed like the optical response in the random pattern state. Consequently, the contrast variation dependent on the picture pattern can be eliminated, and the frame response can be suppressed.

Figure 12:
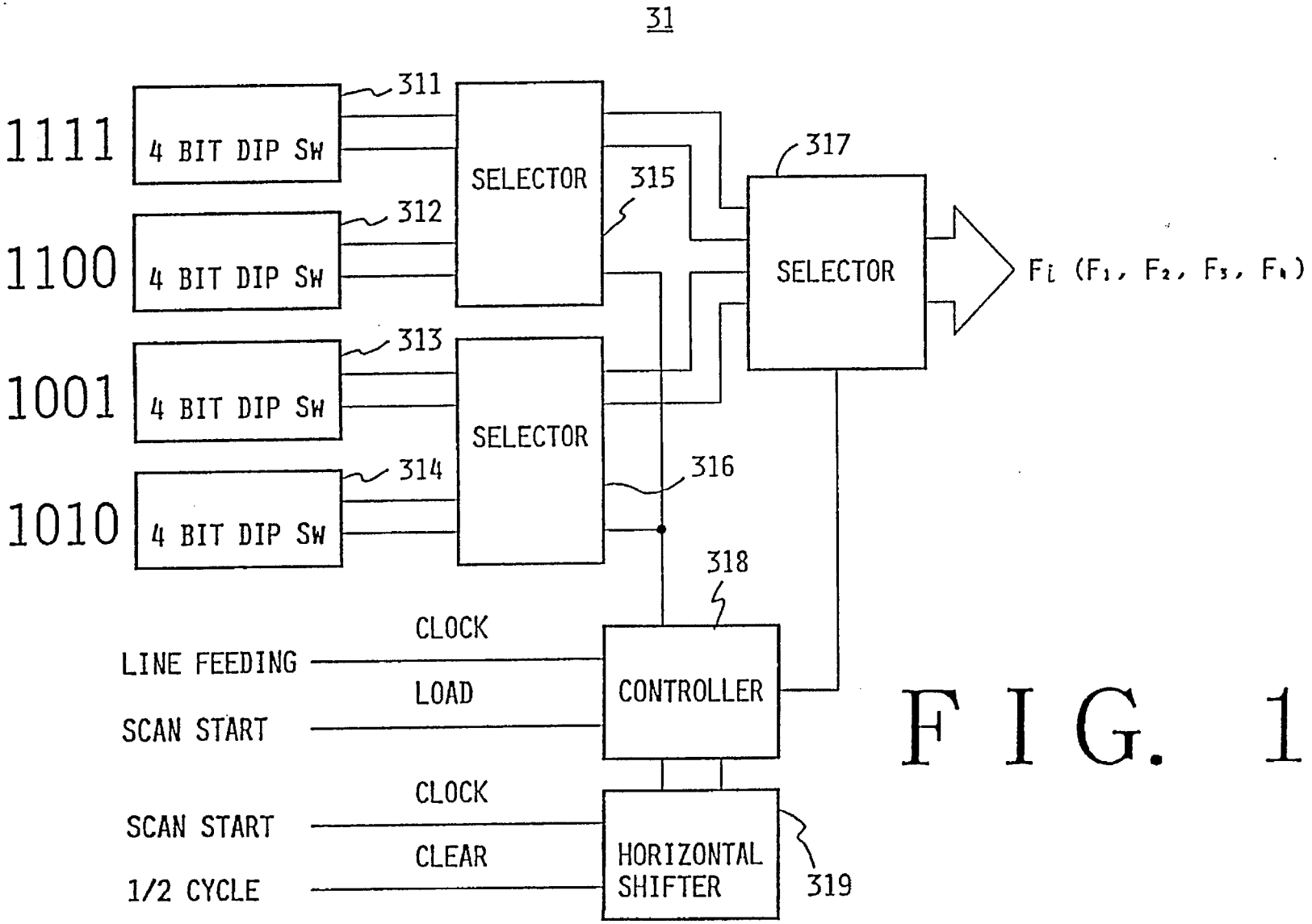
FIG. 12 is a circuit diagram showing an examplified structure of the Walsh function generator suitable for the horizontal shift driving.

FIG. 12 is a circuit diagram showing a detailed construction of the Walsh function generator effective to synthesize the horizontally shifted combination pattern shown in FIG. 10. This generator has basically the same construction as the FIG. 7 Walsh function generator, and can be readily integrated into the drive circuit of the FIG. 5 liquid crystal display device. The difference is that a horizontal shifter 319 is connected to the controller 318. This horizontal shifter 319 receives a clock signal (Clock) generated in response to a scan start, and a clear signal (Clear) generated every half cycle for achieving through the controller 318 the phase shift of the combination pattern of the orthonormal signals. In detail, during the course of the group sequential scanning, the first dip switch 311 is selected by means of the selectors 315 and 317 to output the combination pattern 1, 1, 1, 1 for the first group. Accordingly, the set of the orthonormal signals are represented by $F_1=1$, $F_2=1$, $F_3=1$ and $F_4=1$. For the second group, the second dip switch 312 is selected by means of the selectors 315 and 317 to output the combination pattern 1, 1, 0, 0. Accordingly as shown in FIG. 10, the set of the scanning signals are represented by $F_5=1$, $F_6=1$, $F_7=0$ and $F_8=0$. In similar manner, the third dip switch 313 is selected by means of the selectors 316 and 317 to output the combination pattern 1, 0, 0, 1 for the third group. For the fourth dip switch 314 is selected by means of the selectors 316 and 317 to output the combination pattern 1, 0, 1, 0. Hereafter, the combination pattern is phase-shifted every group to complete the first frame scanning. During the second frame scanning, the starting position is switched from the first dip switch 311 to the second dip switch 312 under the control by the horizontal shifter 319. Consequently, the second dip switch 312 is selected for the first group by means of the selectors 315 and 317 to output the combination pattern 1, 1, 0, 0. Accordingly, the set of the scanning signals are represented by $F_1=1$, $F_2=1$, $F_3=1$ and $F_4=0$ as shown in FIG. 10. For the next second group, the third dip switch 313 is selected by means of the selectors 316 and 317 to output the corresponding combination pattern 1, 0, 0, 1. Accordingly, the set of the applied scanning signals are represented by $F_5=1$, $F_6=0$, $F_7=0$ and $F_8=1$.

Lastly, the description is given to the vertial shift drive of the combination pattern of the orthonormal functions. In case that the fixed combination pattern is utilized for the scanning signals as shown in FIG. 2, the orthonormal signal $F_1$ applied to the first row of the scanning electrode has a sequence pattern of 1, 1, 1, 1 according to the first order Walsh function W1. This sequence pattern is inverted its polarity in the latter half of the first cycle. Then, the same sequence pattern of 1, 1, 1, 1 is again restored in the first half of the second cycle. Thus, the first scanning signal $F_1$ has a period identical to the whole cycle. The second scanning signal $F_2$ has a sequence pattern of 1, 1, 0, 0 according to the second order Walsh function W2. Accordingly, the scanning signal $F_2$ has a period identical to the half cycle. Similarly, the third scanning signal $F_3$ has a period identical to the half cycle, but the signal $F_3$ is phase-shifted from the signal $F_2$. The fourth scanning signal $F_4$ has a sequence pattern 1, 0, 1, 0 within a half cycle according to the fourth order Walsh function W4. Accordingly, the scanning signal $F_4$ has a period identical to the quarter cycle. By such a manner, the fixed sequence patterns are repeatedly used in each cycle so that the frequency of the fourth signal $F_4$ becomes four times as high as that of the first signal $F_1$, and also becomes twice as high as that of the second and third signals $F_2$, $F_3$. The liquid crystal has the frequency-dependent optical response, so that the frame response fluctuation occurs along different scanning electrodes to hinder the display quality. Particularly, such a frame response variation becomes serious when the number of the concurrently selected multiple lines is far smaller than the total line number.

Figure 18:
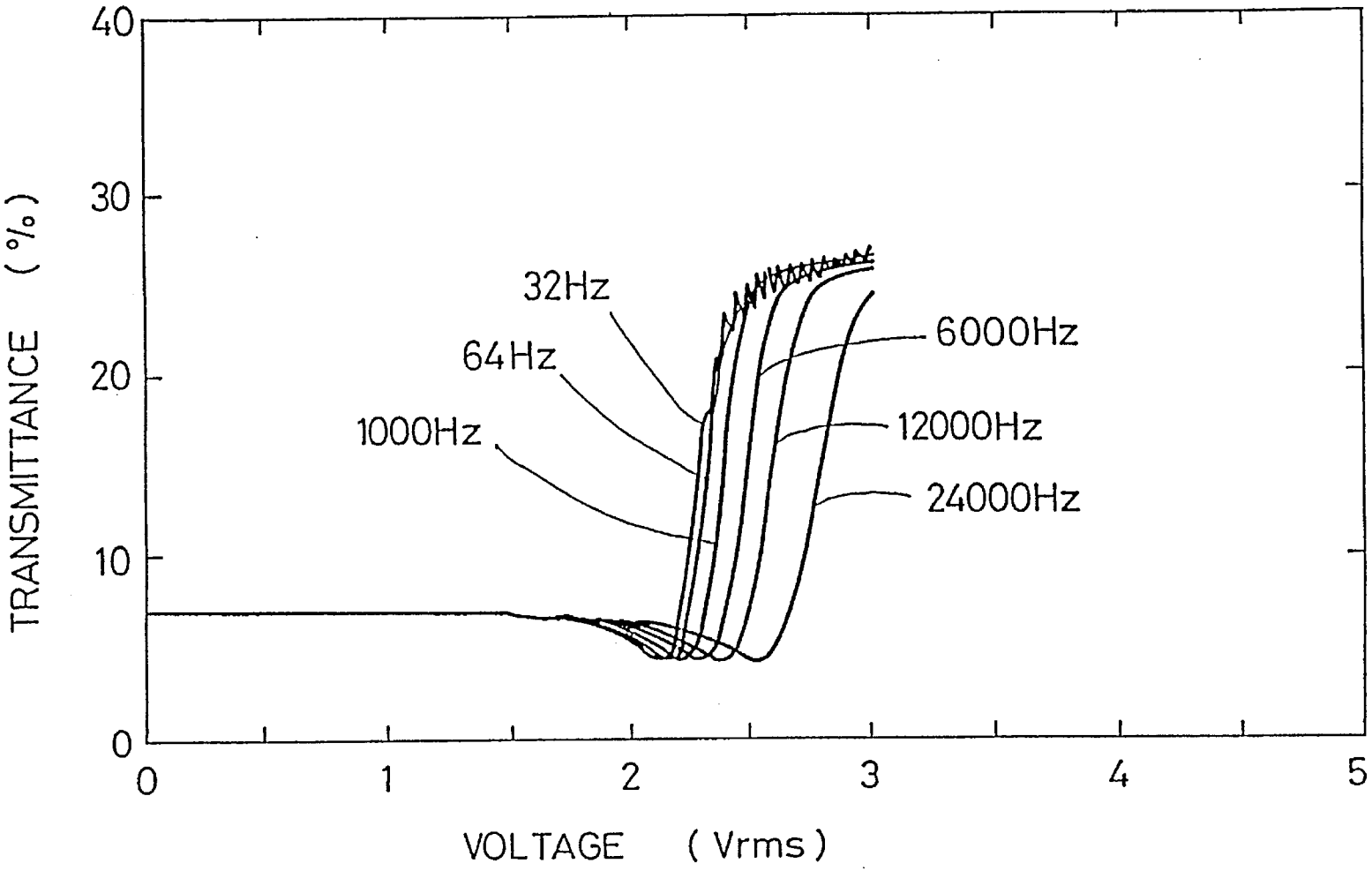
FIG. 18 is a graph showing a frequency dependency of a liquid crystal display device of the plain matrix type.

The multiple line selection method can utilize various waveforms to drive the scanning electrodes; however, generally the orthonormal waveforms may be utilized since the waveforms must be different among the concurrently selected scanning electrodes. Therefore, as the number of the concurrently selected lines increases, the frequency difference of the waveforms increases between the first and last lines of the concurrently selected scanning electrodes. The data signal applied to the signal electrode is computed by dot product of the matrix dot data and the orthonormal waveforms. Further the actual waveform applied to the liquid crystal is a composite of the voltages applied to the scanning and signal electrodes. When the multiple line number n is smaller than $\sqrt{N}$, the voltage of the scanning electrode becomes greater than that of the signal electrode so that the waveform of the scanning electrode significantly attributes to the frequency of the composite waveform. On the other hand, in case that the multiple line number is greater than $\sqrt{N}$, the voltage of the signal electrode becomes greater than that of the scanning electrode dependently on the picture pattern so that the waveform of the signal electrode significantly attributes to the frequency of the composite waveform. Further, as shown in FIG. 18, the driving of the liquid crystal exhibits a certain frequency characteristic such that the transmittance of the liquid crystal varies dependently on the drive frequency. Accordingly in case that the multiple line number n is smaller than the total line number N, a transmittance difference is generated between the first and last lines of the concurrently selected scanning electrodes to cause a horizontal stripe shade on the display at a width of the multiple lines.

Figure 13:
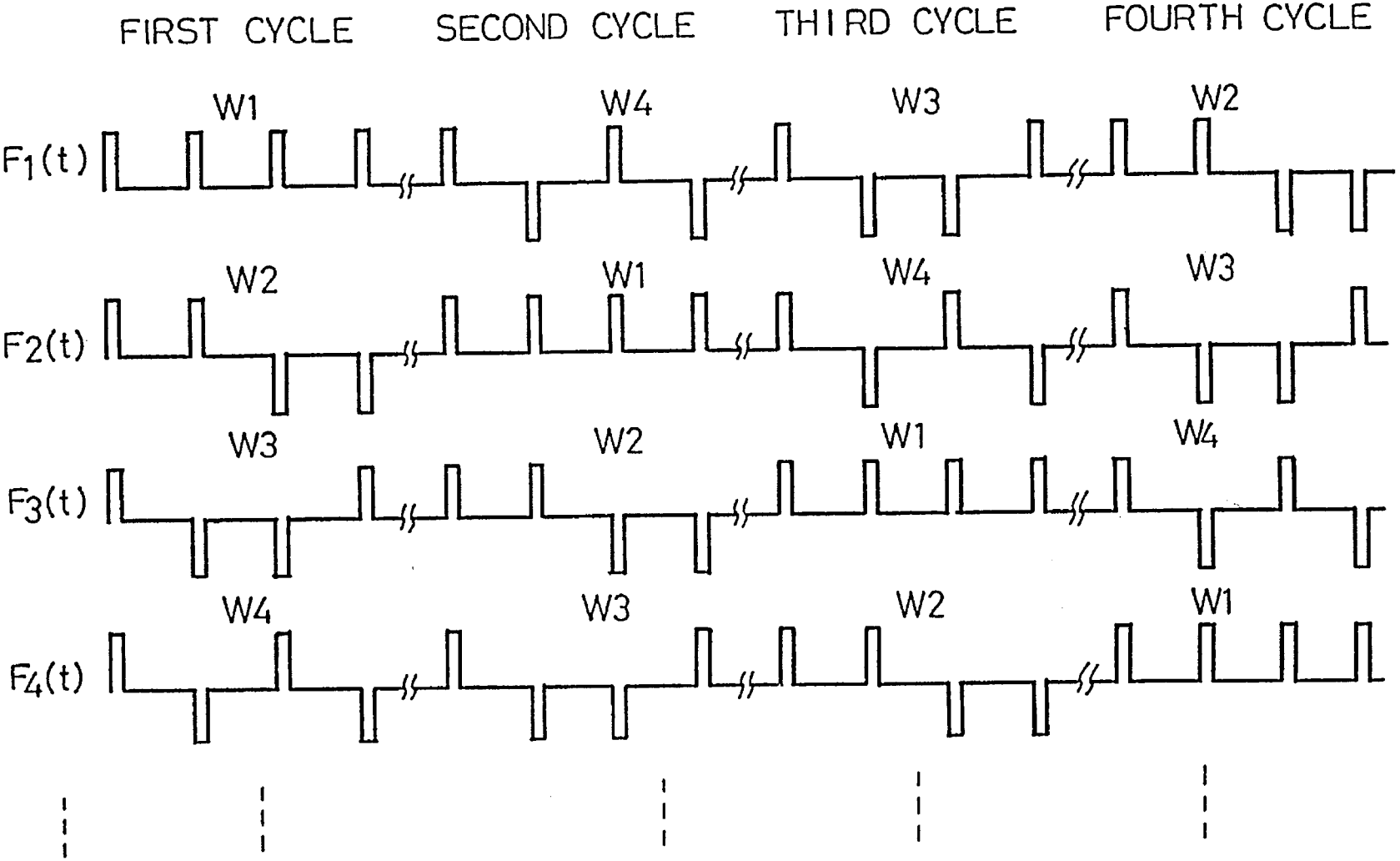
FIG. 13 is a timing chart illustrating the multiple line concurrent driving according to a vertical shift method.

In view of this, the vertical shift method shown in FIG. 13 is effective to average the frequency of the scan signals applied to the respective row electrodes. As shown in the figure, the combination pattern of the orthonormal scan signals is identical to that of FIG. 2 in a preceding half of the first cycle. Namely, the signal $F_1$ corresponds to W1, $F_2$ corresponds to W2, $F_3$ corresponds to W3, and $F_4$ corresponds to W4. In a succeeding half of the first cycle, the set of the signals $F_1$–$F_4$ are merely inverted their polarity. Next in the second cycle, the vertical shift of the combination pattern of the sequence pattern is undertaken such that the combination pattern of W1, W2, W3 and W4 is changed to W4, W1, W2 and W3. Namely, the signal $F_1$ has a sequence pattern of 1, 0, 1, 0 according to W4, the signal $F_2$ has a sequence pattern of 1, 1, 1, 1 according to W1, the signal $F_3$ has a sequence pattern of 1, 1, 0, 0, according to W2, and the signal $F_4$ has a sequence pattern of 1, 0, 0, 1 according to W3. Then, the polarity inversion is effected in the latter half of the second cycle. The vertical shift is again effected subsequently in the third cycle such that the combination pattern is represented by W3, W4, W1 and W2. Similarly, the combination pattern of the fourth cycle is represented by W2, W3, W4 and W1. The combination pattern returns to the first combination pattern of W1, W2, W3 and W4 at the fifth cycle. As understood from the FIG. 13 timing chart, various frequency components are mixed throughout the sequence of cycles with respect to any of the row signals $F_1$, $F_2$, $F_3$ and $F_4$ so as to level the frame response. The orthonormal relation is maintained in each cycle while the vertical shift is sequentially undertaken. Alternatively in this vertical shift mode, interchanging shift of the row signals may be adopted in place of the sequential shift. Further, the vertical shift may be undertaken every of several cycles, rather than every of one cycle.

Figure 14:
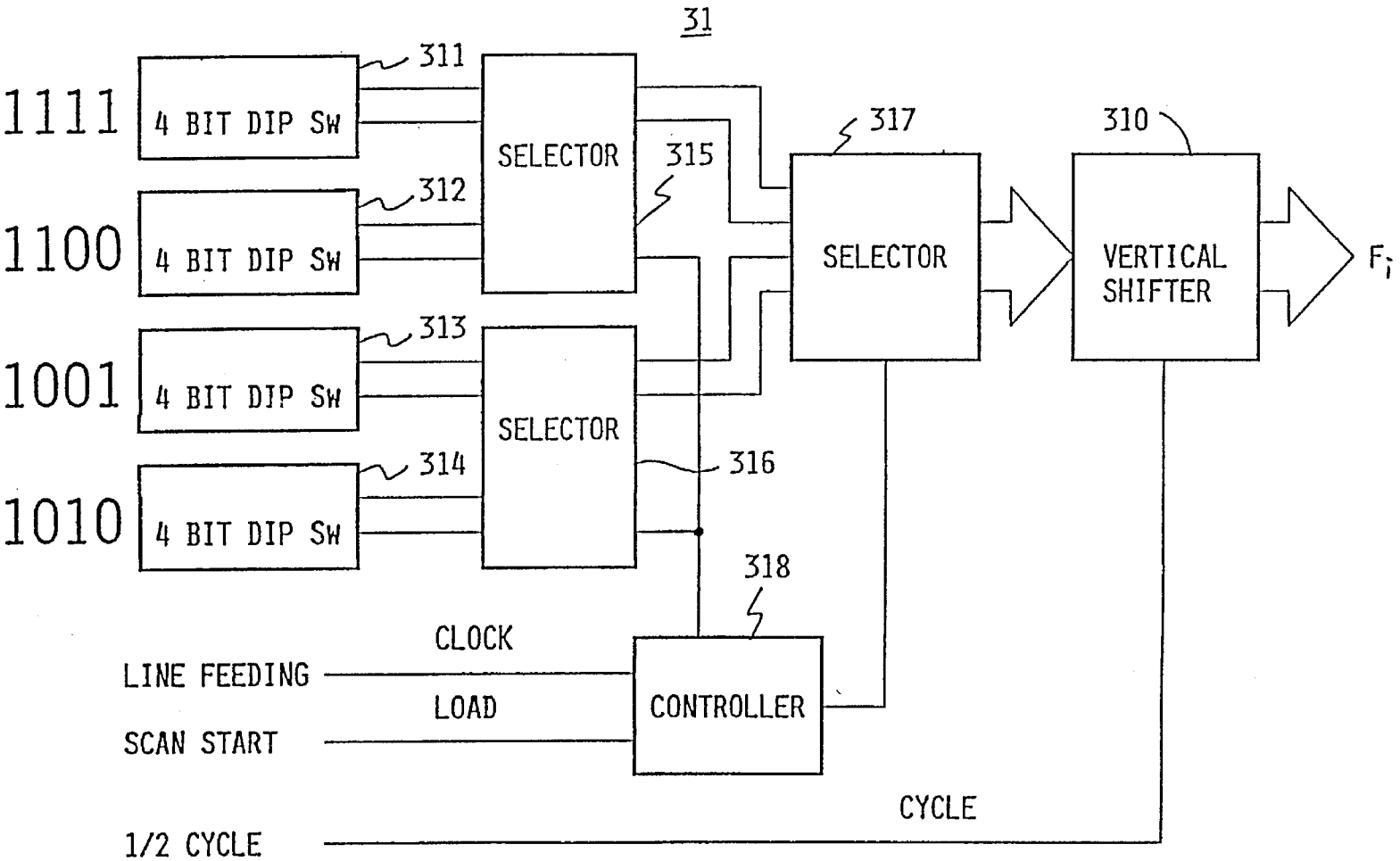
FIG. 14 is a circuit diagram showing an examplified structure of the Walsh function generator suitable for the vertical shift driving.
Figure 15:
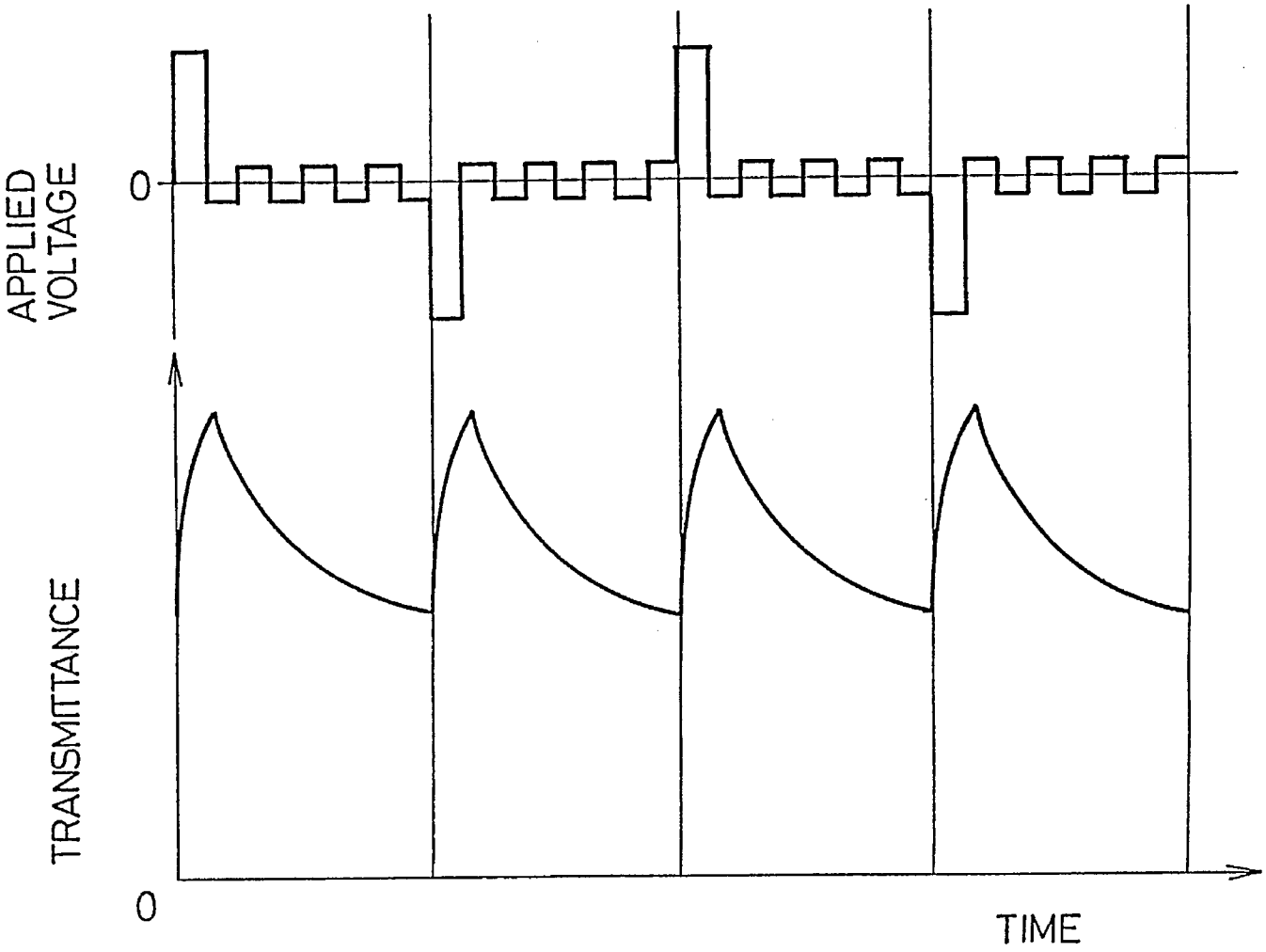
FIG. 15 is a graph showing an optical response of a conventional liquid crystal display device of the plain matrix type.
Figure 16:
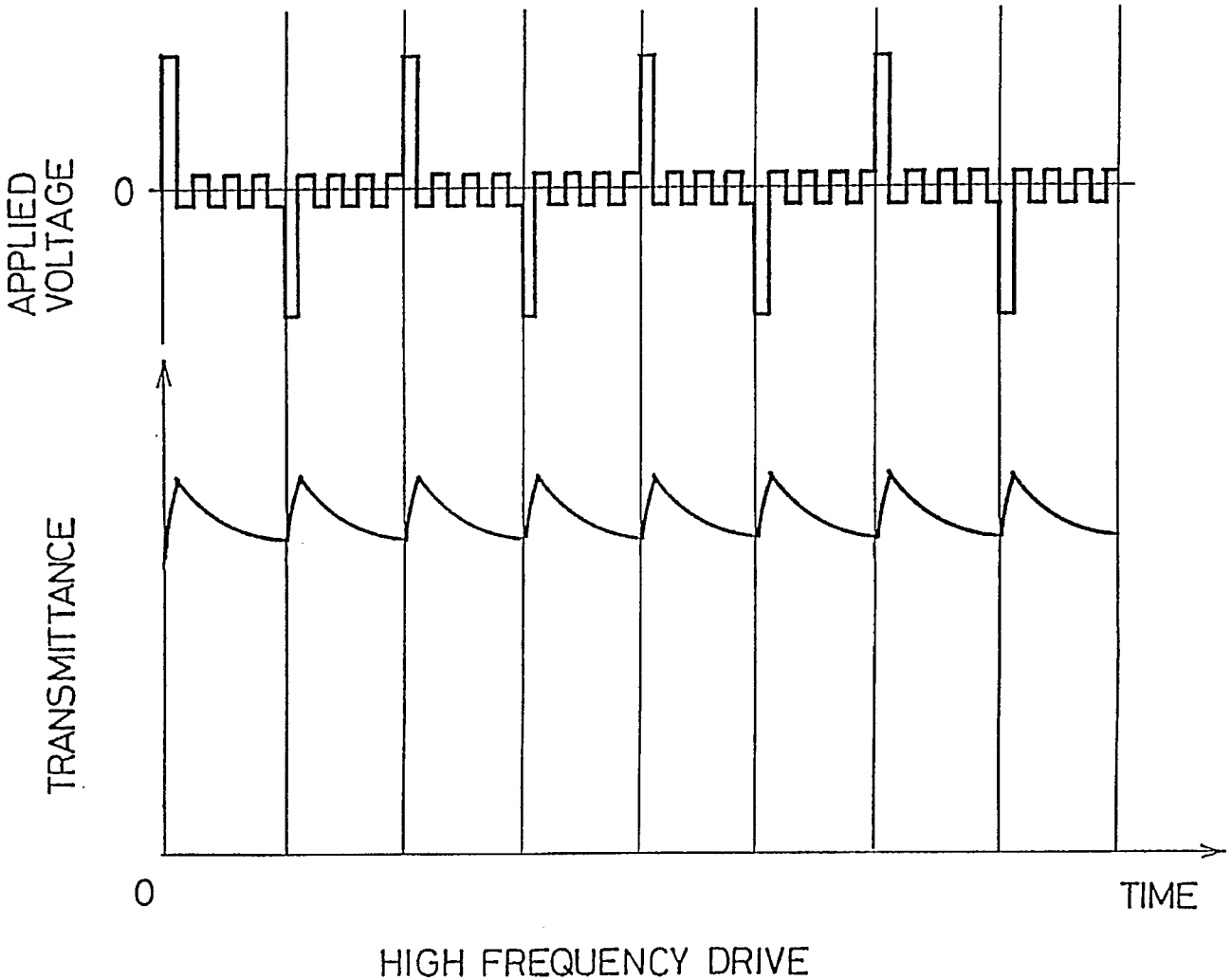
FIG. 16 is a graph showing another optical response of the conventional liquid crystal display device of the plain matrix type.
Figure 17:
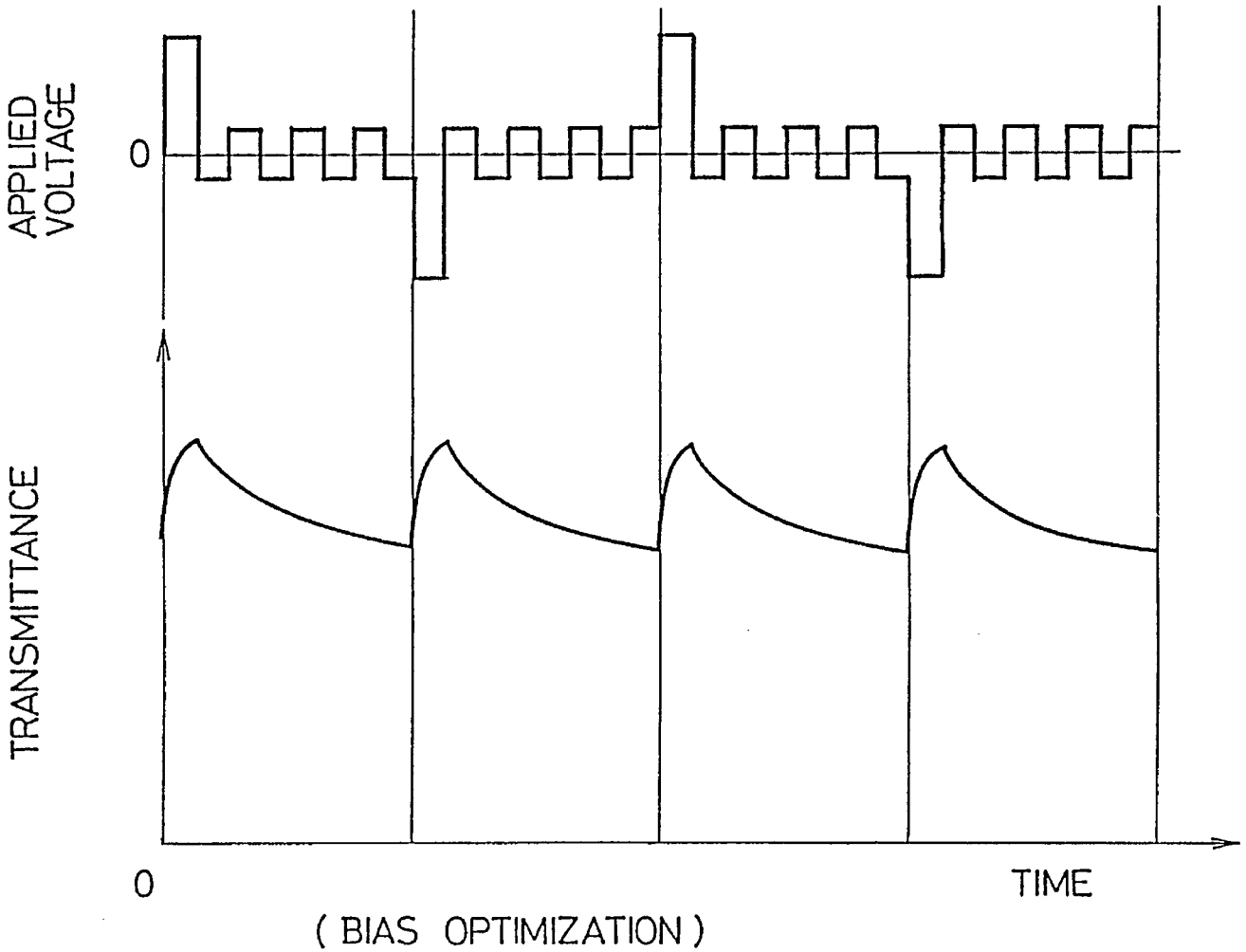
FIG. 17 is a graph showing a further optical response of the conventional liquid crystal display device of the plain matrix type.

FIG. 14 is a circuit diagram showing an example of the Walsh function generator suitable to the vertical shift drive. This Walsh function generator has basically the same construction as that of the FIG. 7 Walsh function generator 31, and is therefore readily integrated into the FIG. 5 drive circuit. The difference is such that a vertical shifter 310 is connected succeedingly to the selector 317. This vertical shifter 310 operates in response to a signal "Cycle" generated every half cycle to effect the vertical shift. In the first half of the first cycle, the set of four scanning signals outputted from the selector 317 are directly transferred to the corresponding scanning electrodes. Then, the polarity inversion is effected at the second half of the first cycle. Then, in the second cycle, the four scan signals are concurrently shifted vertically by one line to feed the scanning electrodes. After the polarity inversion is effected at the latter half of the second cycle, the vertical shift of one line is effected in the first half of the third cycle.

Figure 19:
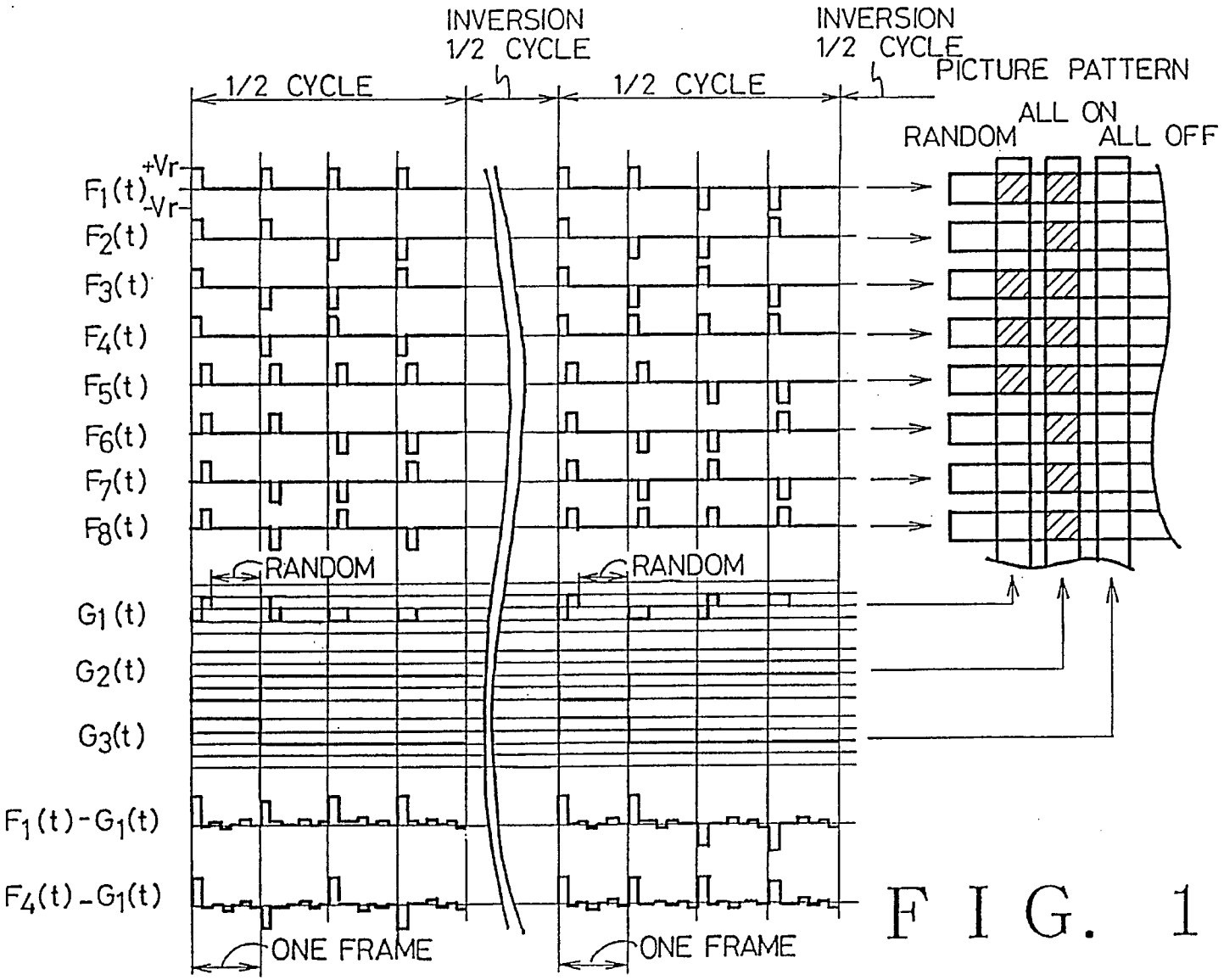
FIG. 19 is a timing chart showing another example of the multiple line concurrent driving according to the vertical shift method.

FIG. 19 shows another example of the vertical shift drive waveforms, in which the shift direction is opposite to that of the FIG. 13 example. In case that four lines are concurrently selected in the multiple selection drive, the scan signals are composed of the Walsh functions, and one lower waveform is shifted upward by one line every cycle. In the FIG. 19 timing chart, each waveform $F_i(t)$ is applied to a corresponding scanning electrode, and four of the scanning signals are concurrently selected to scan the liquid crystal panel from top to bottom. Initially in the first cycle, the first line is set with the waveform of +Vr, +Vr, +Vr, +Vr, the second line is set with the waveform of +Vr, +Vr, −Vr, −Vr, the third line is set with the waveform of +Vr, −Vr, −Vr, +Vr, and the fourth line is set with the waveform of +Vr, −Vr, +Vr, −Vr. In the next cycle, the first line is set with the waveform of +Vr, +Vr, −Vr, −Vr, which has been set to the second line in the previous cycle. Concurrently, the second line is set with the waveform of +Vr, −Vr, −Vr, +Vr, the third line is set with the waveform of +Vr, −Vr, +Vr, −Vr and the fourth line is set with the waveform of +Vr, +Vr, +Vr, +Vr. Therefore, the waveform is shifted by one line at every cycle in similar manner to drive the scanning electrode. On the other hand, the signal electrodes are applied with the data signals $G_1(t)$, $G_2(t)$, $G_3(t)$, - - - , which are obtained by the dot product computation while the combination pattern $F_i(t)$ is changed cyclically. Accordingly, the horizontal stripe shade of the four line width can be eliminated though quite minor transmittance fluctuation may be developed cyclically.

Figure 20:
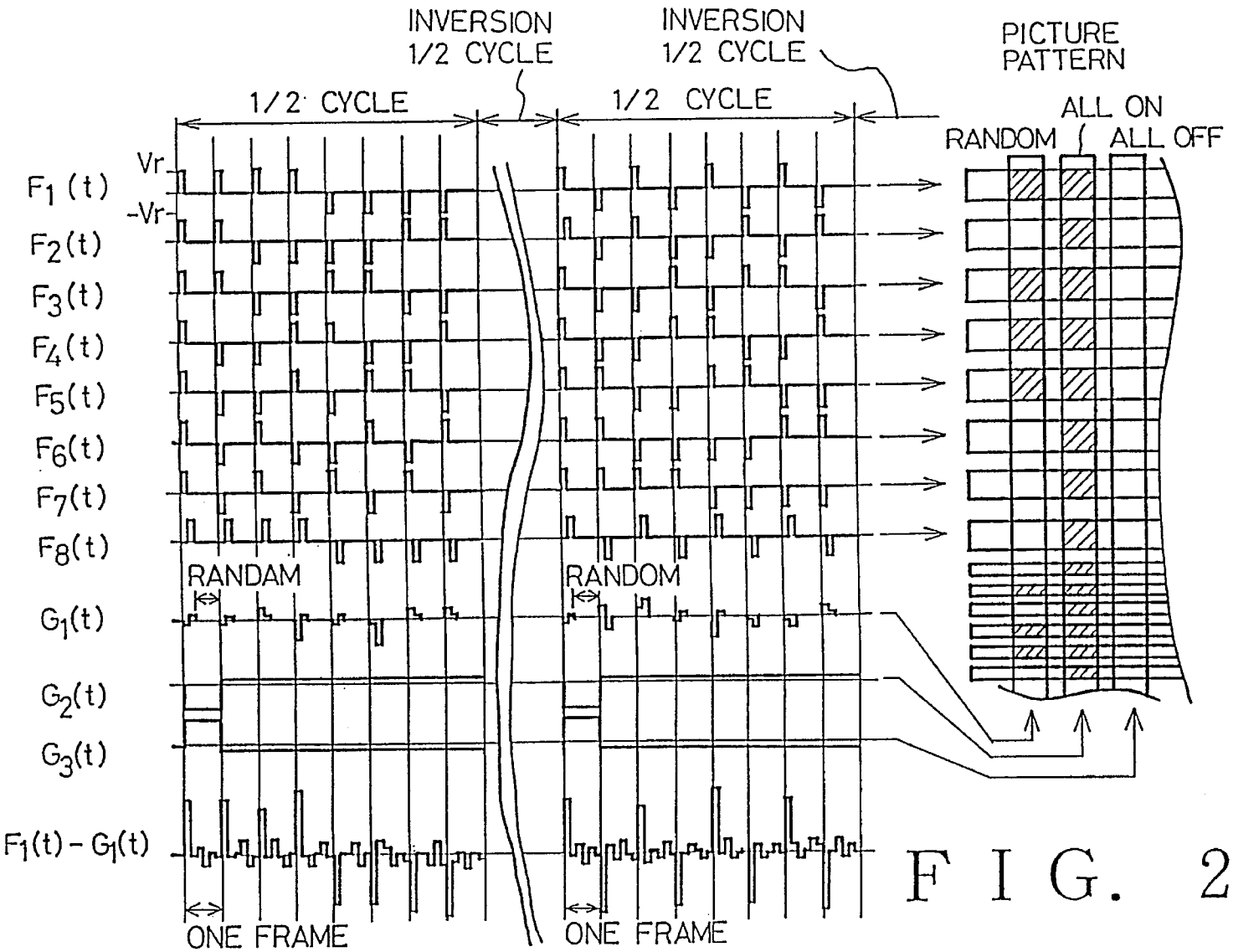
FIG. 20 is a timing chart showing a further example of the multiple line concurrent driving according to the vertical shift method.

FIG. 20 shows further example where seven number of multiple lines are concurrently selected, and the scan signals are determined by the Walsh function. In this example, the first and seventh lines are interchanged with each other, the second and sixth lines are interchanged with each other, and the third and fifth lines are interchanged with each other, so as to update the combination pattern every cycle. In the FIG. 20 timing chart, each waveform $F_i(t)$ is applied to the respective scanning electrode. Seven lines are concurrently selected to scan the liquid crystal panel from top to bottom. Initially in the first cycle., the first line is set with +Vr, +Vr, +Vr, +Vr, −Vr, −Vr, −Vr, −Vr, the second line is set with +Vr, +Vr, −Vr, −Vr, −Vr, −Vr, +Vr, +Vr, the third line is set with +Vr, +Vr, −Vr, −Vr, +Vr, +Vr, −Vr, −Vr, the fourth line set with +Vr, −Vr, −Vr, +Vr, +Vr, −Vr, −Vr, +Vr, the fifth line is set with +Vr, −Vr, −Vr, +Vr, −Vr, +Vr, +Vr, −Vr, the sixth line is set with +Vr, −Vr, +Vr, −Vr, −Vr, +Vr, −Vr, +Vr, and the seventh line is set with +Vr, −Vr, +Vr, −Vr, +Vr, −Vr, +Vr, −Vr. In the next cycle, the first line is applied with +Vr, −Vr, +Vr, −Vr, +Vr, −Vr, +Vr, −Vr, the second line is applied with +Vr, −Vr, +Vr, −Vr, −Vr, +Vr, −Vr, +Vr, the third line is applied with +Vr, −Vr, −Vr, +Vr, −Vr, +Vr, +Vr, −Vr, are fourth line is applied with +Vr, −Vr, −Vr, +Vr, +Vr, −Vr, −Vr, +Vr, the fifth line is applied with +Vr, +Vr, −Vr, −Vr, +Vr, +Vr, −Vr, −Vr, the sixth line is applied with +Vr, +Vr, −Vr, −Vr, −Vr, −Vr, +Vr, +Vr, and the seventh line is applied with +Vr, +Vr, +Vr, +Vr, −Vr, −Vr, −Vr, −Vr. Next, the combination pattern returns to the first cycle to thereby repeatedly drive the scanning electrodes. The signal electrodes receive the respective data signals $G_1(t)$, $G_2(t)$, $G_3(t)$, and so on, which are obtained by dot product computation. The horizontal stripe shade can be eliminated to satisfy a practical level of the display quality.

Figure 21:
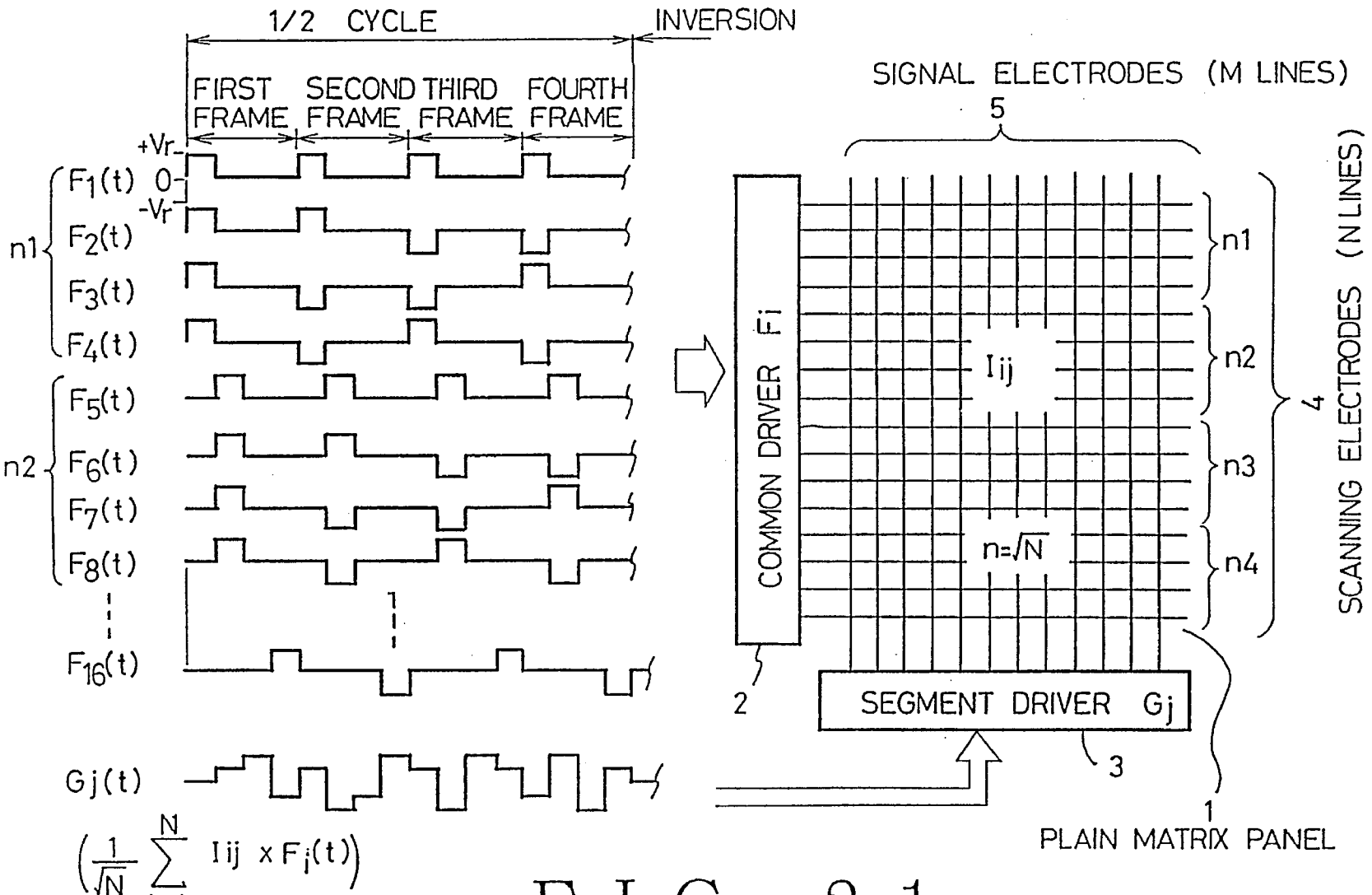
FIG. 21 is a schematic diagram showing the inventive multiple line concurrent driving in which a selected line number is optimized.
Figure 22:
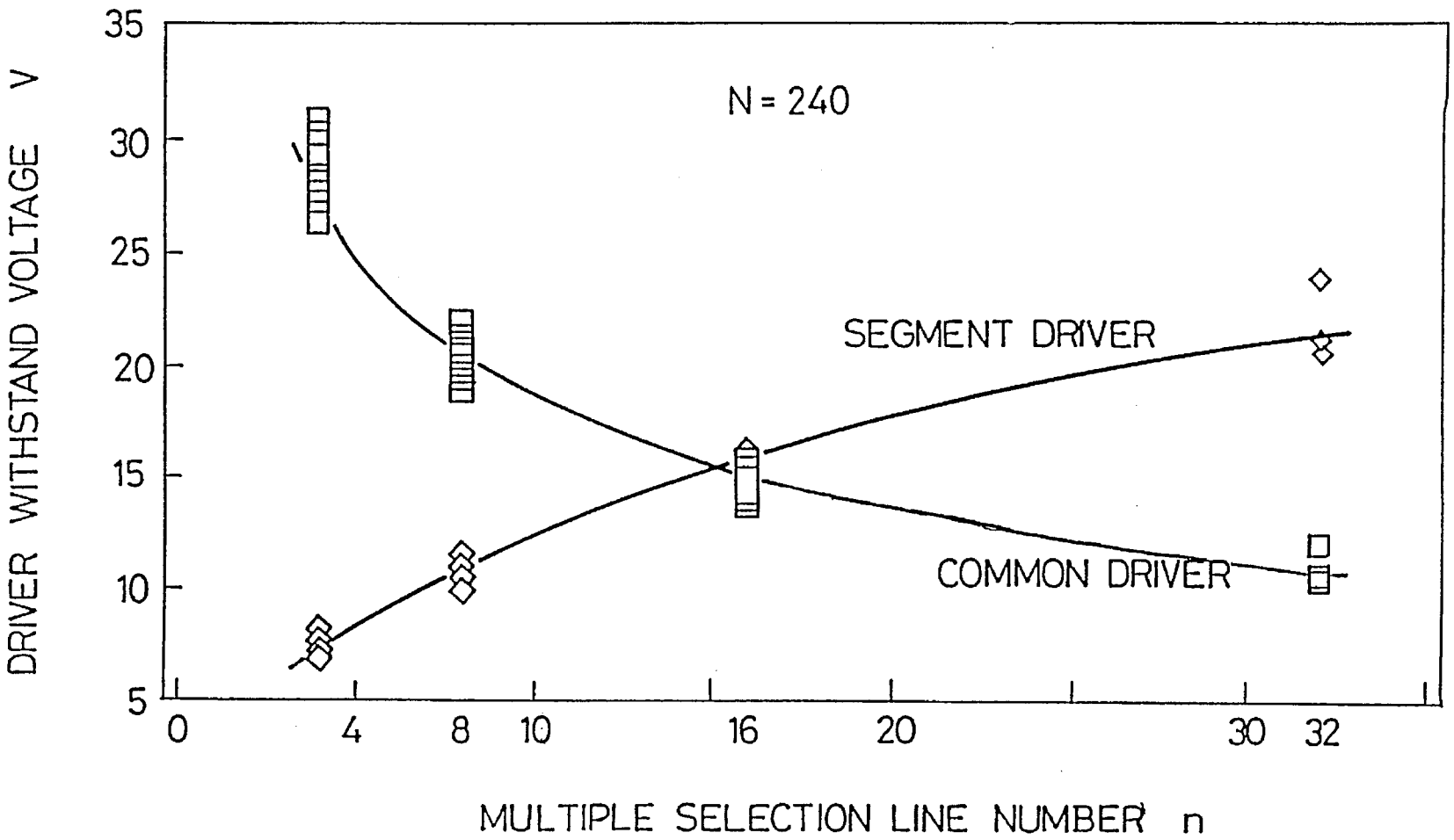
FIG. 22 is a graph showing a relation between a driver withstand voltage and the concurrently selected line number.

FIG. 21 is an illustrative diagram showing the multiple line selection drive having the optimized multiple line number according to the invention. The plain matrix panel 1 has a layered structure containing a liquid crystal layer interposed between rows of scanning electrodes 4 and columns of signal electrode 5. The scanning electrodes 4 have a total line number N. In the figure, N is set to "16" for the simplicity. On the other hand, the signal electrodes 5 have a total line number M. In the illustrated example, M is set to 12 for the simplicity. Further, the liquid crystal layer may be composed of an STN liquid crystal. The plain matrix panel 1 is driven by a common driver 2 connected to the scanning electrodes 4 and a segment driver 3 connected to the signal electrodes 5 to display a desired picture according to a given matrix dot data $I_{ij}$. Each dot data $I_{ij}$ is assigned to a pixel defined at an intersection between the row scanning electrode 4 and the column signal electrode 5. The row number is designated by i, and the column number is designated by j. In this embodiment, the dot data $I_{ij}$ takes "−1" for the ON pixel, and takes "+1" for the OFF pixel.

A set of orthonormal signals $F_i$ is applied to the common driver 2 to concurrently select a given line number of the scanning electrodes 4 in a group sequential manner. On the other hand, the segment driver 3 is supplied with dot product signals which are obtained by the dot product computation between a set of the dot data $I_{ij}$ and the set of the orthonormal signals $F_i$ to drive the signal electrodes 5 in synchronization with the group sequential scanning. According to the invention, the multiple line number of the concurrently selected scanning electrodes of each group is optimized to balance a withstand voltage between the segment driver 3 and the common driver 2. This optimization condition is represented generally by $n=\sqrt{N}$, where N denotes the total line number of the scanning electrodes, and n denotes the multiple line number involved in each group. For example, the illustrated embodiment has the total line number N=16 of the scanning electrodes, and therefore its root square value is calculated to $\sqrt{16}=4$. Consequently, the multiple line number n of each group is set to n=4. Namely, the sixteen number of the scanning electrodes are divided into four groups n1, n2, n 3 and n4.

Further, referring to the signal waveforms shown in FIG. 21, the detailed description is given to the multiple line section method. The voltage waveforms of the orthonormal signals are applied to corresponding scanning electrodes. Each orthonormal signal is set according to Walsh function (FIG. 3) which is complete orthonormal function in (0, 1). In this example, the first four orders of the Walsh functions are utilized to provide a set of row scanning signals orthonormal to each other. For example, with regard to the first group n1 of the scanning electrodes, $F_1$ corresponds to the first order Walsh function. The first order Walsh function is held at a high level throughout one period, so that $F_1(t)$ is composed of a pulse train of 1, 1, 1, 1, where "1" denotes a voltage level +Vr. Further, "0" denotes a voltage level −Vr, and the zero voltage level is maintained in nonselection interval. In similar manner, $F_2(t)$ is composed of a pulse train of 1, 1, 0, 0 corresponding to the second order Walsh function. $F_3(t)$ is composed of a pulse train of 1, 0, 0, 1 corresponding to the third order Walsh function. $F_4(t)$ is composed of a pulse train of 1, 0, 1, 0 corresponding to the fourth order Walsh function. In order to carry out the group sequential scanning, initially respective first pulses of the orthonormal signals $F_1(t)$~$F_4(t)$ are applied to the first group n1. Then, the row lines are scanned downward to select the second group n2. At this moment, the set of the orthonormal signals $F_5(t)$~$F_8(t)$ are applied as a shifted form of the previous set of $F_1(t)$~$F_4(t)$ applied to the first group n1. This group sequential selection is carried out until the fourth group n4 is accessed within one frame to thereby complete the first scanning. Then, similarly, the second, third and fourth scannings are successively carried out to complete a half cycle drive corresponding to one period of the Walsh function set. In a next half cycle, similar group sequential scanning is repeated four times while the polarity of the orthonormal signals is inverted so as to eliminate a DC component.

On the other hand, in the FIG. 21 timing chart, a dot product signal $G_j(t)$ represents a waveform applied to a signal electrode. This dot product signal $G_j(t)$ is obtained by dot product computation between a set at the dot data $I_{ij}$ and the set of the orthonormal signals $F_i(t)$ according to the following equation:

$$G_j(t)=\frac{1}{\sqrt{N}}\sum_{i=1}^{N} I_{ij}\times F_i(t)$$

In this dot product computation, the summation is carried out only for selected lines since the orthonormal signal has a zero level voltage in the nonselection interval. Accordingly, in case of the four line concurrent selection, the dot product signal may have five voltage levels. Namely, the dot product signal needs, as a data signal, a certain number of voltage levels, identical to the multiple line number plus one.

In such a multiple line concurrent driving method, an interval between adjacent high voltage pulses is shortened to achieve equivalently he high frequency effect without reducing a pulse width. Further, a potential difference is reduced between the high voltage pulse level and the bias voltage level so as to raise the bias voltage without hindering the ON/OFF selection ratio to thereby suppress degradation of the display contrast de to the frame response. Moreover, according to the invention, the line number of the concurrently selected electrodes of each group is optimized so as to balance the withstand voltage between the segment and common drivers. For example, as shown in FIG. 21, the 16 number of the scanning electrodes are optimumly divided into four groups each containing four multiple lines. In the FIG. 21 timing chart, the group sequential scanning is repeated four times using the set of orthonormal signals so as to display one picture. The group sequential scanning is repeated four times so that scanning pulses are consequently spread out to lower voltage levels of the orthonormal signals to suppress the withstand voltage required to the common driver. If the scanning electrodes are grouped into every two lines, the group sequential scanning is repeated twice to complete one half cycle. Accordingly, the scanning pulses are not so spread out, resulting in increase of the drive voltage. To the contrary, if the scanning electrodes are grouped every eight lines, the drive voltage is further lowered as compared to the four line grouping. However, in this case, the voltage level of the dot product signal fed to the segment driver is adversely increased. As described before, the dot product signal requires a certain number of voltage levels identical to the multiple line number plus one. Therefore, five levels are required in case of n=4, whereas nine levels are required in case of n=8 to thereby unavoidably boost the voltage range of the dot product signal, resulting in increase of the withstand voltage of the segment driver.

FIG. 52 is a graph showing a measured data of the dependency of the driver withstand voltage on the multiple line number n. In this measurement, the plain matrix panel having the total line number N=240 is driven by the multiple line selection method. In this graph, voltage levels of the orthonormal signals and the dot product signals are measured to determine withstand voltages required to the segment and common drivers while the multiple line number n is varied in a random picture display. As seen from the graph, the common driver withstand voltage lowers as the multiple line number n increases, whereas the segment driver withstand voltage rises as the multiple line number n increases. Both of the withstand voltages are balanced at a vicinity of $n=\sqrt{N}$, in the order of 15 V. In case that a common driver IC is adopted for both of the segment and common drivers, the driver withstand voltage is lowered to the minimum level by optimizing the multiple selection line number n.

Figure 23:
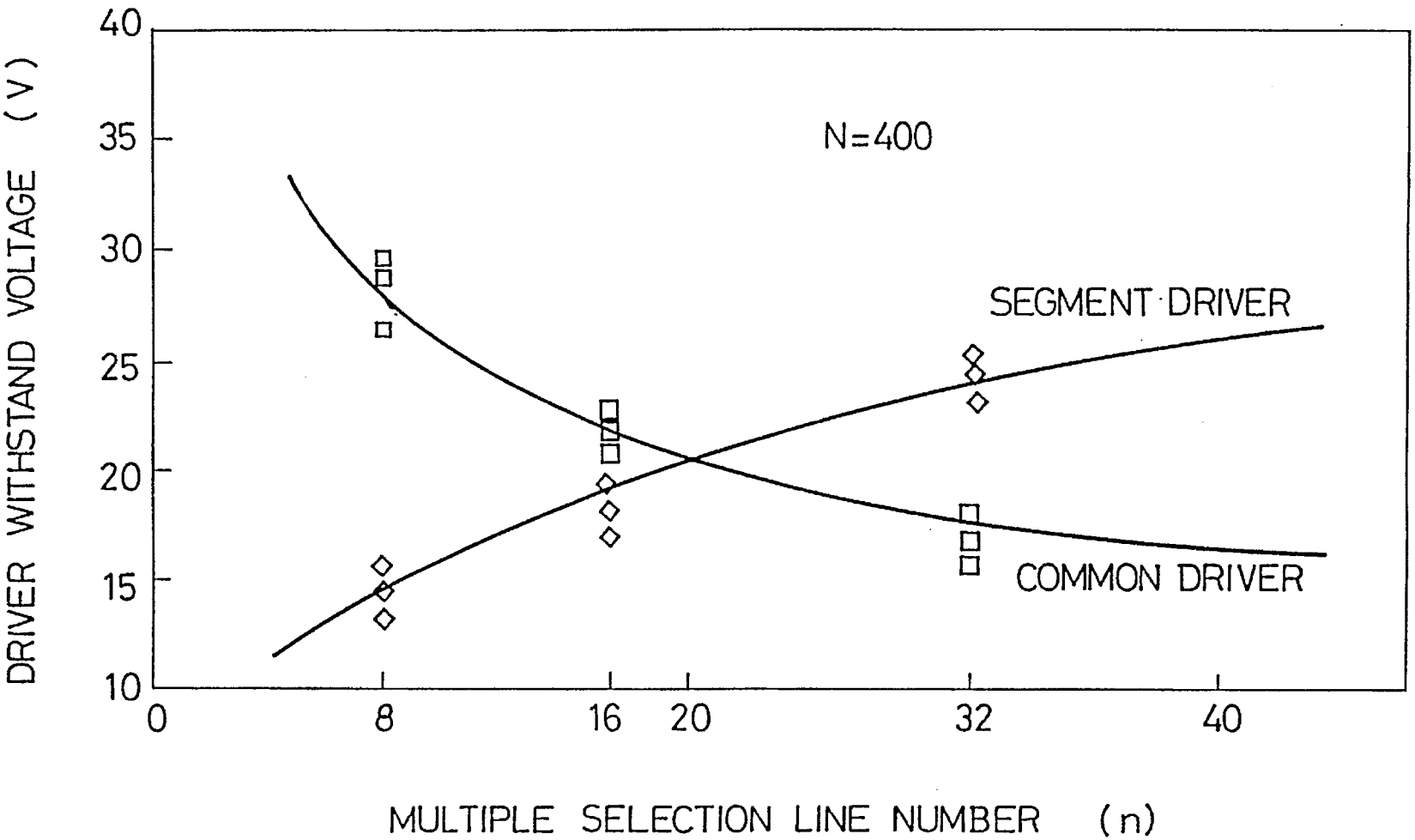
FIG. 23 is a graph likewise showing a relation between the driver withstand voltage and the concurrently selected line number.

FIG. 23 shows another measured result of the driver withstand voltage in case of the total line number N=400. As seen from the graph, the common driver withstand voltage lowers as the multiple selection line number n increases, whereas the segment driver withstand voltage rises as the multiple selection line number n increases. Both of the withstand voltages are balanced with each other around $n=\sqrt{N}$, where the driver withstand voltage is about 20 V.

Lastly, the description is given to the gray shading in the multiple selection drive by the pulse-height modulation.

Figure 24:
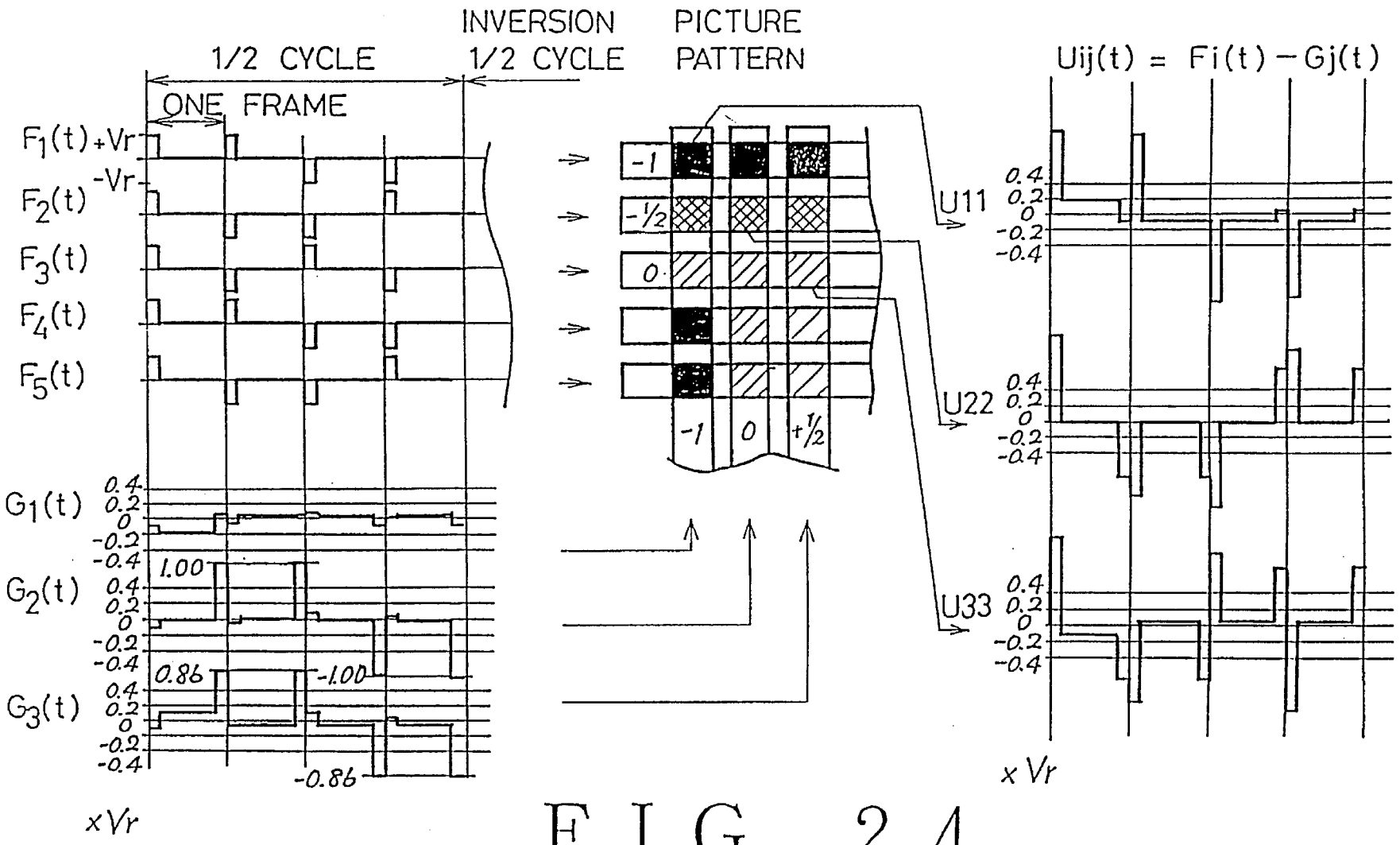
FIG. 24 is a timing chart showing a conventional gray shading method according to a pulse-height modulation.

First, the principle of the gray shading is brightly described for better understanding of the invention. An L number of the row lines are concurrently selected in the multiple selection method. FIG. 24 shows conventional waveforms observed when three lines (L=3) are concurrently selected for the driving. In the figure, $F_1(t)$~$F_5(t)$ denote voltage waveforms applied to the scanning electrode lines, and $G_1(t)$~$G_3(t)$ denote voltage waveforms applied to the signal electrodes lines. The waveforms of the scanning electrode lines are designed according to the Walsh function set which is a complete orthonormal function in (0, 1), where "0" designates −Vr(V), "1" designates +Vr(V), and the waveform has 0(V) in the nonselection interval. The L number of the row lines are concurrently selected to scan a matrix panel from top to bottom. The scanning is repeated several times to complete one period of the Walsh function set. In a next period, the polarity is inverted to eliminate a DC component. On the other hand, with regard to the waveform of the data signal applied to the respective signal electrode line, provided that the total line number is N, a matrix dot data is represented by $I_{ij}$ ("i" denotes a row order and "j" denotes a column order) which has a continuous gray levels of $-1 \leqq I_{ij} \leqq +1$, the data $G_j(t)$ is computed according to the following relation:

$$G_j(t) = \frac{L}{\sqrt{N}} \sum_{i=1}^{N} I_{ij} F_i(t) + \frac{1}{\sqrt{N}} V_{(N+1)j} F_{N+1}(t)$$

where $$V_{(N+1)j} = \left( N - \sum_{m=1}^{N} I^2 mj \right)^{1/2}$$

In the above equations, $V_{(N+1)}$ denotes a virtual dot data assigned to a virtual line provided at (N+1)th order of the row lines. Since the voltage of the row scanning electrode lines is set to 0(V) in the nonseletion interval, the summation is effected actually for selected lines. Therefore, the voltage of the data signal $G_j(t)$ applied to the column signals is calculated only from the first term untile (N/L−1) times. Further, at the last selection of the multiple lines L, the second term calculated according to the above equation is added to the first term. This multiple line selection method has the following advantages:

(1) An interval between adjacent high voltage pulses is shortened to equivalently achieve the high frequency effect without reducing the pulse width.

(2) A potential difference is reduced between the high voltage pulse height and the bias voltage level so as to raise the bias voltage without hindering the ON/OFF selection ratio to thereby suppress degradation of display contrast due to the frame response.

In the computation Of the virtual data $V_{(N+1)}$ of the virtual line (N+1), since the dot data $I_{ij}$ takes a continuous value in the range of "−1" through "+1", the value of $V_{(N+1)}$ becomes maximum to $\sqrt{N}$ when the dot data $I_{ij}$ takes the intermediate value "0". In such a case, the value of $V_{(N+1)}$ increases as the total line number N is relatively great, hence the waveform of the data signal may have a pulsive high voltage when the last multiple lines are selected, dependently on the picture pattern. The waveform actually applied to the liquid crystal is a composite of the row scanning signal and the column data signal, represented by $Uij(t)=F_i(t)-G_j(t)$ such as $F_1(t)-F_2(t)$, $F_2(t)-G_2(t)$ and so on, as shown in FIG. 24. In case that the multiple selection line number L is smaller than $\sqrt{N}$, the voltage of the row scanning electrode is greater than that of the column data signal, so that the frequency of the composite waveform is dominated by the waveform of the scan signal. On the other hand, in case that the multiple selection line number L is greater than $\sqrt{N}$, the voltage of the column electrode is higher than that of the row electrode dependently on the picture pattern, hence the frequency of the composite waveform is dominated by the waveform of the column data signal. Further, the driving of the liquid crystal exhibits a certain frequency characteristic so that a transmittance fluctuation is generated due to the frequency variation. Therefore, in case that the multiple line number L is considerably smaller than the total line number N, the waveform applied to the row scanning electrode dominates the pixel. On the other hand, according to the conventional computation as described above, a pulsive high voltage may be applied to the signal electrodes dependently on the picture pattern, resulting in variation of the frequency characteristic of the composite waveform applied to the liquid crystal to cause a transmittance fluctuation.

Figure 25:
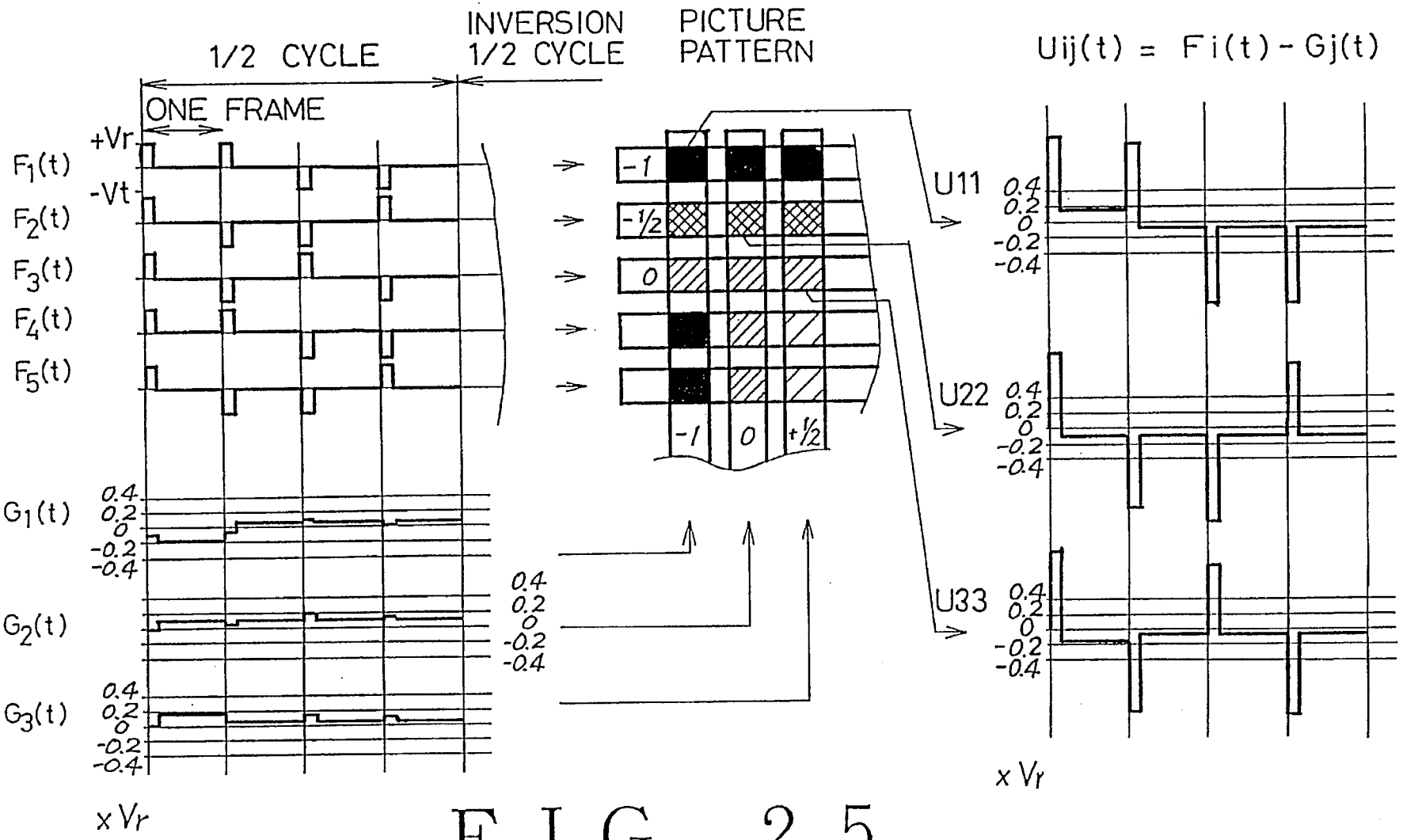
FIG. 25 is a timing chart showing the inventive gray shading method according to the pulse-height modulation.

In view of the above noted drawbacks, the dot product computation is improved in the gray shading method according to the invention. FIG. 25 shows one example of drive waveforms according to the invention. The total line number is set to 240, the multiple selection line number is set to three, and the scanning signals are formed of the Walsh function. In the FIG. 25 timing chart, $F_i(t)$ represents a waveform applied to a corresponding row scanning electrode. Three of the row scanning electrodes are concurrently selected to sequentially scan the liquid crystal panel from top to bottom. The first line is applied with +Vr, +Vr, −Vr, −Vr, the second line is applied with +Vr, −Vr, −Vr, +Vr, and the third line is applied with +Vr, −Vr, +Vr, −Vr. Further, the virtual line is applied with +Vr, +Vr, +Vr, +Vr. In return, the data signal $G_j(t)$ applied to a corresponding signal electrode is computed according to the following equations:

$$G_j(t) = \frac{1}{\sqrt{N}} \sum_{i=1}^{N} I_{ij} F_i(t) + \frac{1}{\sqrt{N}} \sum_{k=1}^{N/L} V_{(N+1)j} F_k(t)$$

$$V_{(L+1)j} = \left( \frac{L}{\sqrt{N}} \cdot \left( N - \sum_{m=1}^{N} I^2 mj \right) \right)^{1/2}$$

For example, $G_1(t)$, $G_2(t)$ and $G_3(t)$ are calculated as shown in the FIG. 25 timing chart provided that the picture pattern is given such that the first row of pixels are set to "−1", the second row of pixels are set to "−½", and the third row of pixels are set to "0", while the remailing pixels are set to "−1", "0", "+½" in the nonselection interval after $F_4(t)$.

As shown in FIG. 24, according to the conventional computation method, the signal electrode may receive the data signal $G_j(t)$ having a high voltage comparable to that of the scan signal $F_i(t)$ dependently on the picture pattern. In contrast, according to the inventive computation method as shown in FIG. 25, the signal electrode constantly receive the data signal $G_j(t)$ having no high voltage regardless of the picture pattern. Accordingly, the liquid crystal receives actual voltage waveforms $U_{11}(t)$, $U_{22}(t)$, $U_{33}(t)$ as shown in FIG. 25, which are similar to each other regardless of the picture pattern.

Figure 26:
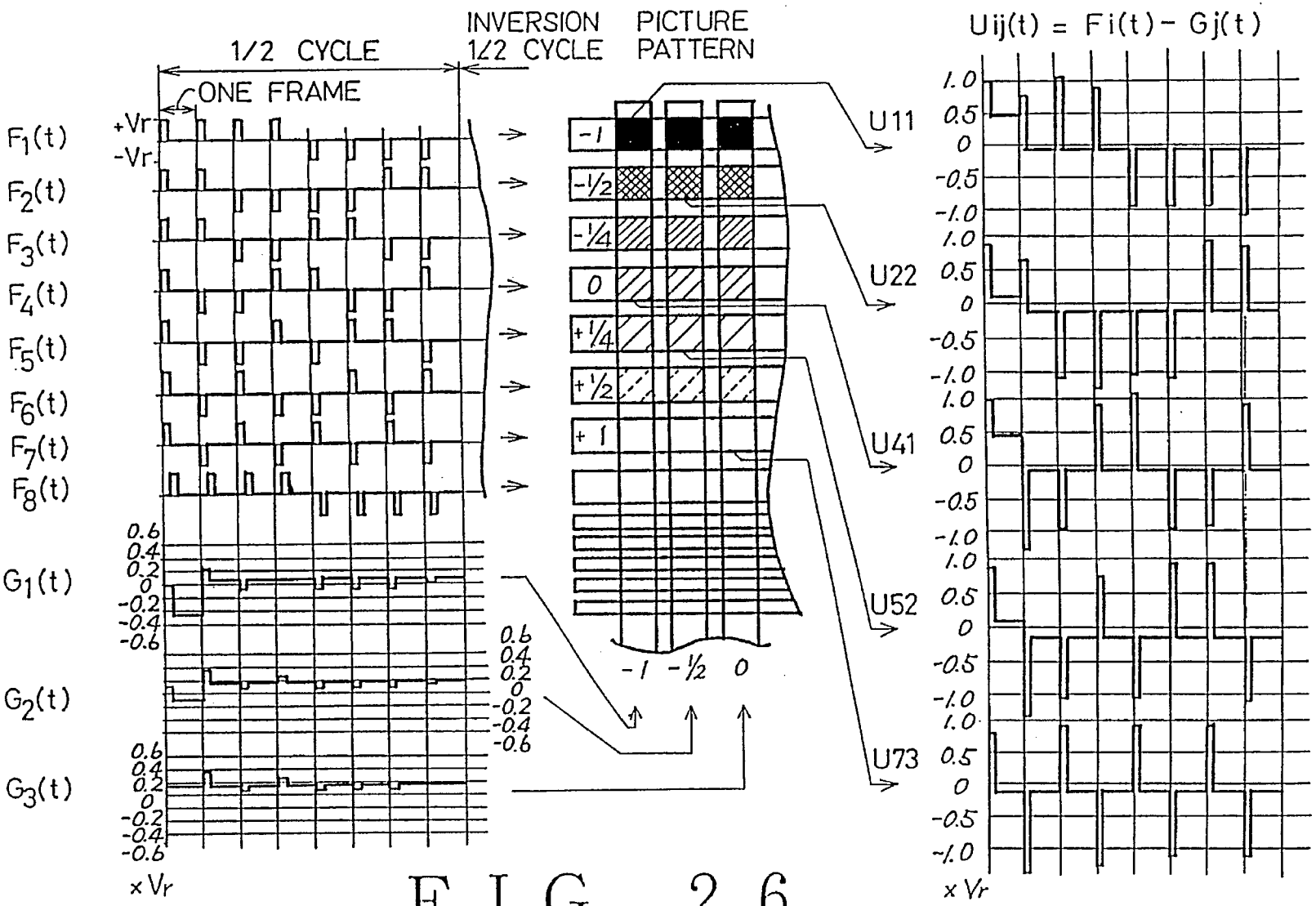
FIG. 26 is a timing chart showing a another example of the inventive gray shading method according to the pulse-height modulation.

FIG. 26 shows another example where the total line number is set to 240, the multiple selection line number is set to seven, and the scan signals are formed of the Walsh function set. In the figure, $F_i(t)$ represents a waveform applied to a corresponding scanning electrode. Seven lines are concurrently selected to sequentially scan the liquid crystal panel from top to bottom. The first line is applied with +Vr, +Vr, +Vr, +Vr, −Vr, −Vr, −Vr, −Vr. The second line is applied with +Vr, +Vr, −Vr, −Vr, −Vr, −Vr, +Vr, +Vr. The third line is applied with +Vr, +Vr, −Vr, −Vr, +Vr, +Vr, −Vr, −Vr. The fourth line is applied with +Vr, −Vr, −Vr, +Vr, +Vr, −Vr, −Vr, +Vr. The fifth line is applied with +Vr, −Vr, −Vr, +Vr, −Vr, +Vr, +Vr, −Vr. The sixth line is applied with +Vr, −Vr, +Vr, −Vr, −Vr, +Vr, −Vr, +Vr. The seventh line is applied with +Vr, −Vr, +Vr, −Vr, +Vr, −Vr, +Vr, −Vr. The virtual line is applied with +Vr, +Vr, +Vr, +Vr, +Vr, +Vr, +Vr, +Vr.

On the other hand, a data signal $G_j(t)$ applied to a corresponding column signal line is computed according to the foregoing equations. For example, $G_1(t)$, $G_2(t)$ and $G_3(t)$ are computed as illustrated in FIG. 26 provided that the picture pattern is given such that the first row of pixels are set to "−1", the second row of pixels are set to "−½" the third row of pixels are set to "¼", the fourth row of pixels are set to "0", the fifth row of pixels are set to "¼", the six row of pixels are set to "½", and the seventh row of pixels are set to "+1", while the remaining pixels are set to "−1", "−½" and "0" for nonselection intervals after $F_8(t)$. In manner similar to the three line selection, the waveform applied to respective pixels is represented by $U_{ij}(t)$ effective to suppress a waveform difference due to the picture pattern.

Further, in case of providing a virtual line for every of the multiple selection lines, the effective voltage concentrated into the (N+1)th line can be calculated everywhen the L lines are selected so as to spread out the effective voltage throughout the waveform to thereby avoid application of a pulsive high voltage to signal electrode lines. In such a case, the value of virtual data $V_{kj}$ is computed according to the following first equation, and the data signal $G_j(t)$ applied to the signal electrode liens is computed according to the following second equation:

$$V_{kj} = \left( L - \sum_{m=1}^{N} I^2 (k * L + m)_j \right)^{1/2} \qquad k = i/L$$

$$G_j(t) = \frac{1}{\sqrt{N}} \sum_{i=1}^{N} I_{ij} F_i(t) + \frac{1}{\sqrt{N}} \sum_{k=1}^{N/L} V_{kj} F_k(t)$$

Namely, the virtual data $V_{kj}$ is computed for the summation at every of the multiple line selection to determine the voltage of the signal electrodes. In this case, the value of $V_{kj}$ reaches only $\sqrt{L}$ at maximum, which is not so high. In the gray shading display by the conventional multiple selection method, the transmittance is fluctuated dependently on the picture pattern, whereas the virtual data is dividedly applied at every of the multiple selection according to the invention such that the actual voltage waveform applied to the liquid crystal is dominated by the frequency of the scanning signals regardless of the picture pattern to thereby make uniform the display state.

As described above, the virtual data $V_{kj}$ is computed and added at every occurrence of the multiple line selection to determine the voltage applied to the signal electrodes. In such a case, the added value of $V_{kj}$ can be calculated by old dot data assigned to precedingly selected multiple lines L, according to the following equation, rather than current dot data assigned to the presently selected multiple lines L.

$$G_j(t) = \frac{1}{\sqrt{N}} \sum_{i=1}^{N} I_{ij} F_i(t) + \frac{1}{\sqrt{N}} \sum_{k=1}^{N/L} V_{(k-A)j} F_k(t)$$

By computing the virtual data $V_{kj}$ using the old dot data assigned to the multiple lines L and retrieved from a memory when the multiple lines L have been selected one or more times before, the computation time interval can be prolonged in the driver circuit to simplify the circuit construction.

When computing the data signal $G_j(t)$ applied to the signal electrodes, the allotted time interval is 72 ns per pixel provided that the total number of pixels of the panel is 240×320×3 (RGB), and the frame frequency is 60 Hz. Accordingly, in order to compute the data signal $G_j(t)$ to feed the same directly to the driver IC without using a buffer memory for storing the computed results, the computation must be finished by 288 ns in case that four dot data are processed in parallel, or the computation must be finished within 576 ns in case that eight dot data are processed in parallel manner. In taking account of access time to the data memory and the computation time, the driver circuit must be made faster, or a plurality of computation units must be provided to carry out the parallel processing. According to the inventive computation method of the virtual data $V_{kj}$, the old data retrieved at the previous selection is utilized such that the substraction of the square value of $I_{ij}$ from L is provisionally carried out at the previous selection, and the root square computation is undertaken at the current selection to provide an additional time interval. Consequently, a number of dot data concurrently computed can be reduced to thereby simplify the driver circuit.

As described above, according to the invention, the driver circuit of the plain matrix type of the liquid crystal panel is provided with the orthonormal signal generating means for generating a set of orthonormal signals. Further, a suitable combination pattern thereof is sequentially applied to the common driver so as to selectively drive the rows of the scanning electrodes in the group sequential manner according to the combination pattern. For this, the plain matrix type of the liquid crystal panel can be driven by the multiple line selection method advantageously with the efficient and simplified circuit construction. The combination pattern of the orthonormal signals may be fixed; however, the combination pattern may be horizontally shifted each group sequential driving, or the combination pattern may be vertically shifted every cycle. The inventive orthonormal signal generating means can form a variable combination pattern while the orthonormal relation is maintained, thereby advantageously suppressing the frame response and improving the display contrast. Further, according to the invention, in the multiple line selection method where the set of the orthonormal signals are sequentially fed to the common driver to selectively drive the rows of the scanning electrodes in the group sequential manner, while the dot product signals obtained by the dot product computation between the dot data set and the orthonormal signal set are fed to the segment driver to drive the column of the signal electrodes in synchronization with the group sequential scanning, the number of concurrently selected row lines within one group is optimized to advantageously balance the withstand voltage between the segment and common drivers. Further, according to the inventive horizontal shift drive, the transmittance can be maintained stably at a high level even in the all ON state without reduction of the optical transmittance of the liquid crystal in response to a period of the frame scanning. Further, the fluctuation of the transmittance can be suppressed under the all ON state so that the optical response becomes similar to that under the random picture display state. Consequently, contrast variation dependent on the picture pattern can be eliminated to reduce the frame response. Further, the inventive vertical shift driving method can eliminate the horizontal stripe shade which would be generated due to the frequency difference of the waveforms applied to the group of the scanning electrodes, thereby obtaining a uniform display. In addition, the inventive gray shade driving method can suppress a pulsive high voltage which would appear in the waveform applied to the signal electrodes dependently on the picture pattern, such that the waveform applied to liquid crystal is dominated by the frequency of the scanning signal regardless of the picture pattern, thereby obtaining a uniform display. In this case, the computation of the virtual data $V_{kj}$ needed for determination of the data signal voltage $G_j(t)$ can be undertaken to start from the previous selection one or more times before, thereby enabling the access of data memory and the computation in time-divided manner so as to achieve simplification and scale-down of the driver circuit.

What is claimed is:

1. A liquid crystal display device comprising: a matrix panel comprising a plurality of rows of scanning electrodes, a plurality of columns of signal electrodes, and a liquid crystal layer interposed therebetween; a common driver for driving the rows of the scanning electrodes; a segment driver for driving the columns of the signal electrodes; orthonormal signal generating means for producing a set of orthonormal signals in orthonormal relation with one another and sequentially providing the orthonormal signals in a predetermined combination pattern to the common driver so as to selectively simultaneously drive a predetermined number of the scanning electrodes to effect group sequential scanning according to the combination pattern; a frame memory for storing input dot data corresponding to an image to be displayed during each frame; dot product computation means for computing a dot product of a set of input dot data sequentially retrieved from the frame memory and the set of orthonormal signals transferred from the orthonormal signal generating means, and for applying a computed dot product to the segment driver to drive the columns of the signal electrodes; and synchronizing means for synchronizing a retrieval timing of the dot data from the frame memory with a transfer timing of the orthonormal signals from the orthonormal signal generating means to thereby repeat the group sequential scanning plural times within each cycle; wherein the orthonormal signal generating means includes means for horizontally shifting a phase of the set of orthonormal signals in response to the group sequential scanning to form the combination pattern and for performing one of vertically shifting and interchanging the orthonormal signals each cycle of the group sequential scannings to for the combination pattern.

2. A liquid crystal display device comprising: a matrix panel comprising a plurality of rows of scanning electrodes, a plurality of columns of signal electrodes, and a liquid crystal layer interposed therebetween; a common driver for driving the rows of scanning electrodes; a segment driver for driving the columns of signal electrodes according to input dot data corresponding to an image to be displayed; means for sequentially providing a set orthonormal signals to the common driver for selectively driving a group comprising multiple rows of scanning electrodes to effect group sequential scanning; and means for computing a dot product of a set of the input dot data and the set of orthonormal signals to produce dot product signals and to provide the dot product signals to the segment driver to drive the columns of signal electrodes in synchronization with the group sequential scanning; wherein the number of rows of multiple scanning electrodes contained in one group is optimized to balance a withstand voltage between the segment driver and the common driver.

3. A liquid crystal display device according to claim 2; wherein the number of rows of multiple scanning electrodes contained in a group is set to approximately the square root of the total number of rows of scanning electrodes.

4. A method of driving a liquid crystal display having a plurality of rows of scanning electrodes, a plurality of columns of signal electrodes and a liquid crystal layer interposed therebetween, comprising the steps of: organizing the display into a plurality of groups, each group comprising multiple rows of scanning electrodes; concurrently selecting a group of multiple rows of scanning electrodes to apply thereto respective scan signals; applying data signals to the signal electrodes in synchronization with the scan signals; and sequentially scanning each group of multiple rows of scanning electrodes to perform a frame scanning, wherein the scan signals have different voltage levels when applied to respective ones of the concurrently selected rows of electrodes in the group such that the scan signals take on a predetermined combination pattern for each group of multiple rows of scanning electrodes and the combination pattern is repeated cyclically each time a predetermine number of frame scannings is carried out, and the combination pattern corresponding to a selected group and the combination pattern corresponding to the succeeding selected group are different from each other within the same frame scanning.

5. A method of driving a liquid crystal display having a plurality of rows of scanning electrodes, a plurality of columns of signal electrodes and a liquid crystal layer interposed therebetween, comprising the steps of: organizing the display into a plurality of groups, each group comprising multiple rows of scanning electrodes; concurrently selecting a group of multiple rows of scanning electrodes to apply thereto respective scan signals; applying data signals to the signal electrodes in synchronization with the scan signals; and sequentially scanning each group of multiple rows of scanning electrodes to perform a frame scanning, wherein the scan signals have different voltage levels when applied to respective ones of the concurrently selected rows of scanning electrodes in the group such that the scan signals take on a predetermined combination pattern for each group of multiple rows of scanning electrodes and the combination pattern is repeated cyclically each time a predetermined number of frame scannings is carried out, and the combination pattern corresponding to each group of multiple rows of scanning electrodes during a frame scanning is different from the combination pattern corresponding to the same group during a succeeding frame scanning.

6. A method of driving a liquid crystal panel having a plurality of rows of scanning electrodes, a plurality of columns of signal electrodes and a liquid crystal layer interposed therebetween, comprising the steps of: organizing the display into a plurality of groups, each group comprising multiple scanning electrodes; concurrently selecting a group of a multiple rows of scanning electrodes to apply thereto respective scan signals; applying data signals to the columns of signal electrodes in synchronization with the scan signals; and sequentially scanning each group of multiple rows of scanning electrodes to perform a frame scanning, wherein the scan signals have different voltage levels when applied to respective ones of the concurrently selected rows of scanning electrodes such that the scan signals constitute a predetermined combination pattern for each group of multiple rows of scanning electrodes and the combination pattern is repeated cyclically each time a given number of the frame scannings are carried out, and wherein each signal electrode has a data signal voltage $G_j(t)$ applied thereto computed according to the following equation based on the scanning signal $F_i(t)$ and a dot data $I_{ij}$:

$$G_j(t)=\frac{1}{\sqrt{N}}\sum_{i=1}^{N} I_{ij}F_i(t)+\frac{1}{\sqrt{N}}\sum_{k=1}^{N/L} V_{(N+1)j}F_k(t)$$

where i=1,2,3 . . . is a respective of row of scanning electrodes, j=1,2,3, . . . is a respective column of signal electrodes, N is the total number of rows of scanning electrodes and $V_{(L+1)_j}$ denotes data assigned to a virtual line of the scanning electrode and added once for each group of L scanning electrodes, wherein L is the number of rows of scanning electrodes in each group, and is computed according to the following equation:

$$V_{(L+1)j}=\left(\frac{L}{\sqrt{N}}\cdot\left(N-\sum_{m=1}^{N} I^2 mj\right)\right)^{1/2}$$

whereby the data of the virtual line is added equidividedly each time L rows of scanning electrodes are selected.

7. A method of driving a liquid crystal display having (N) rows of scanning electrodes, a plurality of columns of signal electrodes and a liquid crystal interposed therebetween, comprising the steps of: organizing the display into a plurality of groups, each group comprising (L) rows of scanning electrodes; concurrently selecting a group of (L) scanning rows of electrodes to apply thereto respective scan signals; applying data signals to the columns of signal electrodes in synchronization with the scan signals; and sequentially scanning each group of multiple rows of (L) scanning electrodes to perform a frame scanning, wherein the scan signals have different voltage levels when applied to respective ones of the concurrently selected rows of scanning electrodes such that the scan signals constitute a given combination pattern for each group of multiple rows of scanning electrodes and the combination pattern is repeated cyclically each time a predetermined number of frame scannings is carried out, and wherein each signal electrode column has a data signal voltage $G_j(t)$ applied thereto which is computed according to the following equation based on the scanning signal $F_i(t)$ and input dot data $I_{ij}$:

$$G_j(t)=\frac{1}{\sqrt{N}}\sum_{i=1}^{N} I_{ij}F_i(t)+\frac{1}{\sqrt{N}}\sum_{k=1}^{N/L} V_{(k-A)j}F_k(t)$$

wherein i=1,2,3, . . . is the number of rows of scanning rows, j =1,2,3, . . . is the number of columns of signal electrodes, N is the total number of rows of scanning electrodes and $V_{kj}$ denotes data assigned to a virtual line of the scanning electrode and added once for each group of L scanning electrodes, and is computed according to the following equation:

$$V_{kj}=\left(L-\sum_{m=1}^{N} I^2(k*L+m)_j\right)^{1/2} \quad k=i/L$$

whereby the data of the virtual line which is added at the (L+1)th line is calculated for addition each time L rows of scanning electrodes are selected according to the dot data assigned to the L scanning electrodes.

8. A method of driving a liquid crystal display having a plurality of rows of scanning electrodes, a plurality of columns of signal electrodes and a liquid crystal layer interposed therebetween, comprising the steps of: organizing the display into a plurality of groups, each group comprising multiple rows of scanning electrodes; concurrently selecting a group of multiple rows of electrodes to apply thereto respective scan signals; applying data signals to the columns of signal electrodes in synchronization with the scan signals; and sequentially scanning each group of multiple rows of scanning electrodes to perform a frame scanning, wherein the scan signals have different voltage levels when applied to respective ones of the concurrently selected rows of scanning electrodes such that the scan signals constitute a given combination pattern for each group of multiple rows of scanning electrodes and the combination pattern is repeated cyclically each time a predetermined number of frame scannings is carried out, and wherein each signal electrode has a data signal voltage $G_j(t)$ applied thereto which is computed according to the following equation based on the scanning signal $F_i(t)$ and input dot data $I_{ij}$:

$$G_j(t)=\frac{1}{\sqrt{N}}\sum_{i=1}^{N} I_{ij}F_i(t)+\frac{1}{\sqrt{N}}\sum_{k=1}^{N/L} V_{kj}F_k(t)$$

where i=1, 2,3, . . . is the number of rows of scanning electrodes, j=1,2,3, . . . is the number of columns of signal electrodes N is the total number of rows of scanning electrodes L is the number of scanning electrodes in each group and $V_{kj}$ denotes a data assigned to a virtual line of the scanning electrode and added once for each group of L scanning electrodes, and is computed according to the following equation:

$$V_{kj}=\left(L-\sum_{m=1}^{N} I^2(k*L+m)_j\right)^{1/2} \quad k=i/L$$

whereby the data of the virtual line which is added at the (L+1)th line is calculated for addition each time L rows of scanning electrodes are selected according to previous dot data assigned to the L rows of scanning electrodes when selected for scanning "A" times earlier where "A" denotes an integer less than ten.

* * * * *